US006513914B2

(12) United States Patent
Misumi et al.

(10) Patent No.: US 6,513,914 B2
(45) Date of Patent: Feb. 4, 2003

(54) LIQUID DISCHARGING HEAD, METHOD FOR MANUFACTURING LIQUID DISCHARGING HEAD, AND LIQUID DISCHARGING APPARATUS

(75) Inventors: Yoshinori Misumi, Tokyo (JP); Hiroyuki Ishinaga, Tokyo (JP); Yoichi Taneya, Kanagawa (JP); Hiroyuki Sugiyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/916,435

(22) Filed: Jul. 30, 2001

(65) Prior Publication Data

US 2002/0024560 A1 Feb. 28, 2002

(30) Foreign Application Priority Data

Jul. 31, 2000 (JP) ..... 2000-232409

(51) Int. Cl.[7] ..... B41J 2/05; B41J 2/17
(52) U.S. Cl. ..... 347/65; 347/94
(58) Field of Search ..... 347/20, 65, 94, 347/12, 13, 57

(56) References Cited

U.S. PATENT DOCUMENTS 4,723,129 A 2/1988 Endo et al. ..... 347/56
5,278,585 A 1/1994 Karz et al. ..... 346/140
5,793,393 A * 8/1998 Coven ..... 347/65
6,168,264 B1 1/2001 Yoshihira et al. ..... 347/65

FOREIGN PATENT DOCUMENTS

| | | |
|---|---|---|
| EP | 0 436 047 A1 | 9/1991 |
| EP | 0 721 841 A2 | 7/1996 |
| EP | 0 819 528 A2 | 1/1998 |
| EP | 0 982 136 A | 1/2000 |
| EP | 1 005 996 A | 7/2000 |
| JP | 6-31918 | 2/1994 |
| JP | 9-48127 | 2/1997 |
| JP | 9-323420 | 12/1997 |
| JP | 10-24588 | 1/1998 |

* cited by examiner

*Primary Examiner*—Craig Hallacher
*Assistant Examiner*—Michael Brooke
(74) *Attorney, Agent, or Firm*—Fitzpatrick, Cella, Harper & Scinto

(57) ABSTRACT

A boundary nozzle which is contained in a block that has not been driven and is situated at the boundary with a driving block that is driven prior to the block containing the boundary nozzle contains a second stopper which has a length in a liquid flow direction longer than that of a first stopper contained in a driving nozzle in the driving block that is driven prior. A near-boundary nozzle adjacent to the boundary nozzle has a third stopper which has a length in a liquid flow direction longer than that of the first stopper but shorter than the second stopper. Thus, recording irregularities owing to meniscus regression are suppressed.

17 Claims, 16 Drawing Sheets

LIQUID DISCHARGING HEAD, METHOD FOR MANUFACTURING LIQUID DISCHARGING HEAD, AND LIQUID DISCHARGING APPARATUS

BACKGROUND OF THE INVENTION

1. Field of the Invention

The present invention relates to a liquid discharging head which discharges a desired liquid by generating bubbles with thermal energy or the likes a method for manufacturing liquid discharging head, and a liquid discharging apparatus, and particularly relates to a liquid discharging head using a movable separation film which is displaced using the generation of bubbles.

Note that with the present invention, the term "record" refers not only to applying meaningful images such as characters or shapes to recording media, but also to applying images without any particular meaning, such as patterns, to recording media Also, with the present invention, the term "not yet driven" refers to the state of an article which is to be sequentially driven, but the time for this article to be driven has net yet come.

2. Description of the Related Art

There conventionally is known the so-called bubble jet recording method which is an ink-jet recording method wherein, with a recording device such as a printer or the like, energy such as thermal energy or the like is applied to liquid ink in a channel to cause bubbles therein, thereby discharging ink from discharging orifices due to an operating force based on the sudden change in volume due to the bubbles generated, the discharged ink adhering to a recording medium to form images. As disclosed in U.S. Pat. No. 4,723,129, recording apparatuses using this bubble jet recording method generally comprise discharging orifices for discharging ink, channels connecting to the discharging orifices, and electro-thermal converters serving as energy generating means for discharging ink disposed within the channels.

According to such a recording method, high-quality images can be recorded a high speed with little noise, and also, and the discharge orifices for discharging ink can be arrayed at high density with heads for this recording method, so this method is advantageous in many ways, such as yielding high-resolution recorded images with small apparatuses and also facilitating color image recording. Accordingly, in recent years, bubble jet recording devices have come to be used with many sorts of office equipment, such as printers, photocopiers, facsimile devices, and so forth, and even with industrial systems such as textile printing machines.

As bubble jet technology has come to be used in products in various fields, various types of demands have come to be made, as described next.

Driving conditions for providing liquid discharging methods or the like whereby suitable ink discharge based on stable bubble generation can be provided with high-speed ink discharging have been proposed, and improved channel shapes for obtaining liquid discharging heads with fast refilling speed (i.e., channels which have discharged ink are speedily refilled with ink for the next discharge) from the perspective of high-speed printing, have been proposed, in order to obtain high-quality images.

In addition to such heads, an invention has been disclosed in Japanese Patent Laid-Open No. 6-31918, which takes note of back waves (pressure directed toward the opposite direction of the discharge orifices) generated at the time of generating bubbles, and provides a structure which prevents back waves which are lost energy in the discharging action. The invention disclosed here has a triangular portion of a triangular plate member facing a heater which generates bubbles with this invention, the back waves can be temporarily suppressed, though slightly, with the plate member. However, no mention whatsoever is made of the relation between growth of the bubble and the triangular portion, and no thought has been given thereto, so the above invention has the following problems.

That is to say, with the invention disclosed in the above publication, the heater is situated at the base of a recess and there is no linear connection state with the discharging orifice, so the droplet form is unstable, and further growth of the bubble is permitted from around the apex portion of the triangle, so the bubble grows from one side of the triangular plate member to the other side, i.e., over the entirety, and consequently a normal bubble grows to its full size in the liquid as if the plate member did not even exist. Accordingly, the plate member is unrelated to the grown bubble. Conversely, the entirety of the plate member is surmounted by the bubble, is in the stage of the bubble shrinking, disturbances are generated in the process of refilling ink to the heater situated in the recess, resulting in minute bubbles being accumulated therein, and eventually disturbing the principle of discharge based on growing bubbles itself.

Next, EP Patent Laid-Open No. 436047A1 discloses an invention wherein a first valve is disposed between the discharge orifice area and the bubble generating portion for closing these off, and a second valve is disposed between the bubble generating portion and the ink supplying portion for completely closing these off, the first and second valve being alternately opened and shut (FIGS. 4 through 9 in EP 436047A1). However, this invention sections these three chambers into two each, so at the time of discharging the ink following the droplet causes massive tailing, so the number of satellite dots is far greater than with a normal discharge method which performs bubble growth, reduction, and dissipation (it is assumed that meniscus regression during to dissipation of the bubble will not be usable). Also, at the time of refilling, the liquid is supplied to the bubble generating portion as the bubble dissipates, but liquid cannot be supplied to the discharging orifice area until the next bubble generation starts, so not only are the irregularities in discharged liquid droplets great, but also the discharge response frequency is extremely great, and accordingly this invention is not at a practical level.

On the other hand, the present assignee has proposed many inventions using movable members (plate-shaped members having a free end closer to the discharge orifice side than the fulcrum) which are completely different from the above-describe conventional art and effectively contribute to discharging of liquid droplets. Of such inventions, Japanese Patent Laid-Open No. 9-48127 discloses an invention wherein the upper limit of displacement of the moving member is restricted, in order to prevent slight disturbance in the behavior of the aforementioned movable member. Also, Japanese Patent Laid-Open No. 9-323420 discloses an invention wherein the position of the common liquid chamber upstream from the movable member is shifted toward the free end side of the movable member using the advantages of the movable member, i.e., shifted downstream, thereby increasing the refilling capability. These inventions were based upon the conception of temporarily enveloping the growth of the bubble with the movable member and then from that state discharging the bubble all at once toward the discharging orifice side, and accordingly, various individual elements relating to formation of droplets by the entire bubble and relations thereof were not noted.

As a next stage, the present assignee has disclosed in Japanese Patent Laid-Open No. 10-24588 an invention wherein a part of the bubble generating area is released from the movable member, as an invention taking note of bubble growth due to pressure wave propagation (acoustic wave) as an element relating to liquid discharge. However, this invention also only focuses on the growth of the bubble at the time of discharging liquid, and accordingly various individual elements relating to formation of droplets by the entire bubble and relations thereof are not noted.

While it is known that the front portion of bubbles (edge shooter type) with conventionally-known film boiling greatly affects discharging, there have conventionally been no inventions taking note of using this portion to effectively contribute to formation of discharging droplets, so the present inventors have diligently studied this matter to reach a technological solution.

Further the present inventors took notice of the displacement of the movable portion and generation of the bubble, and eventually reached the following useful understanding.

That understanding is to restrict the displacement of the free end as to the growth of the bubble with a stopper for the movable member, which is a displacement restricting member of the movable member. Restricting he displacement of the movable member with the stopper restricts the bubble from growing in the upstream side of the channel, so energy for discharging the liquid is effectively transferred to the lower side where the discharge orifice is formed.

FIG. 14 shows a side view of an example of an edge-shooter type liquid discharging head having a stopper.

A device substrate 301 having a heat-generating member 310 which is the bubble generating means and a movable member 311, a top plate 302 having formed thereupon a stopper 312 with the rear side thereof extended in the upstream direction, and an orifice plate 305 having discharging a discharging orifice 304 formed therein, are provided.

The channel 303 through which the liquid flows is formed by the device substrate 301 and the top plate 302 being fixed in a layered manner. Also, multiple channels 303 are arrayed for one liquid discharging head, connecting to the discharging orifices 304 for discharging liquid formed downstream (to the left side in FIG. 13). A bubble generating area exists near the area of the face where the heat-generating member 310 and the liquid come into contact. Also, a great-capacity common liquid chamber 306 is provided in the upstream direction of each channel 303 (to the right side in FIG. 13), so as to connect simultaneously. In other words, the channels 303 are formed so as to branch off of the single common liquid chamber 306. The height in the liquid chamber of this common liquid chamber 306 is formed so as to be higher than the height in the channel of the channels 303.

The movable member 311 is of a cantilever type supported at one end, fixed to the device substrate 301 at the upstream side of the flow of ink, and is vertically free to move as to the device substrate 301 at the portion further downstream from a fulcrum 311*a*. In the initial state, the movable member 311 is positioned generally parallel to the device substrate 301 while maintaining a gap with the device substrate 301.

The movable member 311 disposed on the device substrate 301 is positioned such that the free end 311*b* is situated at approximately the center area of the heat generating element 310. Also, the stopper 312 provided to the top plate 302 restricts the amount of displacement of the free end 311*b* in the upwards direction by the free end 311*b* of the movable member 311 coming into contact with the stopper 312. At the time that the amount of displacement of the movable member 311 is restricted by the movable member 311 coming into contact with the stopper 312 (i.e., in the event that the movable member is in contact), the channel 303 is essentially closed off between the movable member 311 and stopper 312 on upstream, and the movable member 311 and stopper 312 on downstream, by the movable member 311 and the stopper 312.

Next, FIG. 15 shows each of the movable members in the state of coming in contact with their stoppers, at the time of discharging ink.

The free end 311*b* of the movable member 311 is displaced upwards by the generated bubble 340 at the time of discharging ink, and comes into contact with the stopper 312. In the event that the bubble 340 further grows in the state that this free end 311*b* is in contact with the stopper 312, the movable member 311 warps toward the top plate 302, and deforms into a convex shape.

Now, in the event that multiple heat-generating members are formed on such as liquid discharging head, energy is not simultaneously applied to multiple heat-generating members, but rather the block driving method is used, wherein the heat-generating members are separated into multiple blocks made up of heat-generating members which discharge at approximately the same time, and the heat-generating members are driven in units of blocks. This is performed to prevent efficiency from suffering due to applying electric signals to all heat-generating members at the same time which would increase the current flowing simultaneously and require a power source capable of supplying a great current, and also to prevent efficiency from deteriorating due to voltage from the power source dropping between heat-generating member lines.

However, in the event that driving is performed by block driving with a liquid discharging head having the above movable members and stoppers, there has been a problem in that a first discharging droplet 350 discharged from a nozzle 371 near the boundary is smaller than other discharged droplets, and also the discharging speed is slow, thereby sometimes resulting in recording irregularities, as shown in FIG. 15. This FIG. 15 is a diagram schematically illustrating the amount of ink discharged and the discharging speed, and represents that while originally ink is not simultaneously discharged from the leading driving nozzle 351 and the near-boundary nozzle 371, ink is being simultaneously discharged from the leading driving nozzle 351 and the near-boundary nozzle 371.

The present inventors studied the case of deterioration in the discharging amount and the discharging speed at the near-boundary nozzles, and found that this is a phenomena unique to liquid discharging heads having the above movable members and stoppers. That is, this occurs due to the fact that the force for drawing surrounding ink into the nozzle at the time of the bubble dissipating is far greater with liquid discharging heads having the movable members and stoppers as compared to conventional heads. As shown in FIG. 16, this is supposed to be due to the amount of ink within the near-boundary nozzle 371 at the time of driving this near-boundary nozzle 371 decreasing, since following dissipation of the bubble in the leading driving nozzle 351, filling of ink is attempted not only from the common liquid chamber 306 but also from the nozzles at the boundary of the trailing driving block 370 that has not been driven and from the near-boundary nozzle 371 thereof, situated at the boundary and near the boundary with the block that has been driven.

SUMMARY OF THE INVENTION

The present invention has been made in light of the above problems, and accordingly it is an object thereof to provide a liquid discharging head, a method for manufacturing liquid discharging head, and a liquid discharging apparatus, wherein recording irregularities, due to liquid being drawn in from adjacent channels, are suppressed.

To this end, the liquid discharging head according to the present invention comprises: a plurality of heat-generating elements for generating thermal energy for generating bubbles in a liquid; a plurality of discharging orifices corresponding to each of the heat-generating elements, whereby the liquid is discharged; a plurality of channels connecting to the discharging orifices and having bubble generating areas for generating bubbles in the liquid; a plurality of movable members provided in the bubble generating areas so as to corresponding to each of the heat-generating elements, each having a free end which is displaced in accordance with growth of a bubble; a plurality of restricting portions provided in the channels so as to correspond to each of the movable members, for restricting the amount of movement of the movable members; and a common liquid chamber connected to each of the channels, for supplying liquid to each of the channels; wherein the heat-generating elements are sectioned into a plurality of blocks for each of the heat-generating elements discharging ink in a generally simultaneous manner, the heat-generating elements are sequentially driven in time-division in increments of the blocks, and the liquid is discharged from the discharge orifices by the energy of the bubbles being generated and wherein each of the restricting portions comprise a plurality of a first restricting portion and at least one second restricting portion having a shape such that the fluid resistance of liquid from the discharging orifice side toward the common liquid chamber is greater than the fluid Resistance generated at the first restricting portion.

With the liquid discharging head according to the present invention configured as described above, the second restricting portion, where fluid resistance of liquid from the discharge side to the common liquid chamber is greater than the fluid resistance of the first restricting portion, suppresses liquid in channels not driven, from being drawn out under the effects of refilling channels having heat-generating members that have been driven, and accordingly, meniscus regression formed at discharging orifices connecting to channels having second restricting portions can be restricted.

Also, each second restricting portion may be contained in a trailing driving block which is adjacent to a leading driving block which is the block that is driven first, and driven later than the leading driving block, and be disposed within the channel positioned adjacent to the boundary between the leading driving block and the trailing driving block. In this case, meniscus regression formed at discharging orifices connecting to channels positioned at the boundary between the leading driving block and the trailing driving block which is most readily affected by the refilling of the leading driving block, can be particularly effectively suppressed by forming a second restricting portion in channels positioned adjacent to this boundary.

Each of the second restricting portions may be greater in dimensions that the first restricting portion.

The liquid flow direction length of each restricting portion which is the length in the direction which the liquid flows through the channel may be longer for the second restricting portion than for the first restricting portion, the frontal projection area of each restricting portion in the direction which the liquid flows through the channel may be greater for the second restricting portions than for the first restricting portions, and further the spacing between the second restricting portion and a wall face forming the channel may be narrower than the spacing between the first restricting portion and a wall face forming the channel.

Also, each of the restricting portions may contain at least a third restricting portion which has a greater fluid resistance than the first restricting portion and a smaller fluid resistance than the second restricting portion, disposed within the channel positioned adjacent to the channel wherein the second restricting portion is disposed.

The method for manufacturing a liquid discharging head according to the present invention comprises: a plurality of channels formed by joining an essentially flat substrate having a plurality of movable members corresponding to each of a plurality of heat-generating elements for generating thermal energy for generating bubbles in a liquid, the movable members each having a free end which is displaced in accordance with growth of a bubble, with a top plate formed with a groove portions having a plurality of restricting portions corresponding to each of the movable members, for restricting the amount of displacement of the movable members, the plurality of channels connecting to a plurality of discharging orifices for discharging the liquid and having bubble generating areas for generating bubbles in the liquid; and a common liquid chamber connected to each of the channels, for supplying liquid to each of the channels; wherein the heat-generating elements are sectioned into a plurality of blocks for each of the heat-generating elements discharging ink in a generally simultaneous manner, the heat-generating elements are sequentially driven in time-division in increments of the blocks, and the liquid is discharged from the discharge orifices by the energy of the bubbles being generated; wherein the method comprises a step for forming the top plate such that each of the restricting portions comprise a plurality of a first restricting portion and at least one second restricting portion having a shape such that the fluid resistance of liquid from the discharging orifice side toward the common liquid chamber is greater than the fluid resistance generated at the first restricting portion.

With the method for manufacturing the liquid discharging head according to the present invention configured as described above, a liquid discharging head can be manufactured wherein the second restricting portion, where fluid resistance of liquid from the discharge side to the common liquid chamber is greater than the fluid resistance of the first restricting portion, suppresses liquid in channels not driven, from being drawn out under the effects of refilling channels having heat-generating members that have been driven, and accordingly, meniscus regression formed at discharging orifices connecting to channels having second restricting portions can be restricted.

Also, the method for manufacturing the liquid discharging head according to the present invention may further comprising a step wherein each of the second restricting portions contained in a trailing driving block which is adjacent to a leading driving block which is driven first, and driven later than the leading driving block, is formed within the channel positioned adjacent to the boundary between the leading driving block and the trailing driving block.

The method may further comprise a step wherein each of the second restricting portions is formed greater in dimensions that the first restricting portion.

Further, the method for manufacturing a liquid discharging head according to the present invention may further comprise a step for forming the second restricting portion such that the liquid flow direction length of each restricting portion which is the length in the direction which the fluid flows through the channel is longer for the second restricting portion than for the first restricting portion, or a step for forming the second restricting portion such that the frontal projection area of each restricting portion in the direction which the fluid flows through the channel is greater for the second restricting portion than for the first restricting portion, or a step for forming the second restricting portion such that the spacing between the second restricting portion and a wall face forming the channel is narrower than the spacing between the first restricting portion and a wall face forming the channel.

Also, the method for manufacturing a liquid discharging head according to the present invention may further comprise a step for forming for each of the restricting portions at least one third restricting portion which has a greater fluid resistance than the first restricting portion and a smaller fluid resistance than the second restricting portion, disposed within the channel positioned adjacent to the channel wherein the second restricting portion is disposed.

The liquid discharging apparatus according to the present invention comprises: a liquid discharging head according to the present invention; and a control unit for controlling sequential driving of the blocks.

The liquid discharging apparatus according to the present invention, configured as described above, has a liquid discharging head wherein the second restricting portion, where fluid resistance of liquid from the discharge side to the common liquid chamber is greater than the fluid resistance of the first restricting portion, suppresses liquid in channels not driven, from being drawn out under the effects of refilling channels having heat-generating members that have been driven, and accordingly, meniscus regression formed at discharging orifices connecting to channels having second restricting portions can be restricted, so discharging irregularities due to meniscus regression can be suppressed.

The liquid discharging apparatus according to the present invention may comprise medium transporting means for transporting a recording medium for receiving liquid discharged from the liquid discharging head, and may record by discharging ink from the liquid discharging head so that ink adheres to the recording medium.

Further objects, features and advantages of the present invention will become apparent from the following description of the preferred embodiments with reference to the attached drawings.

DESCRIPTION OF THE PREFERRED EMBODIMENTS

Figure 1:
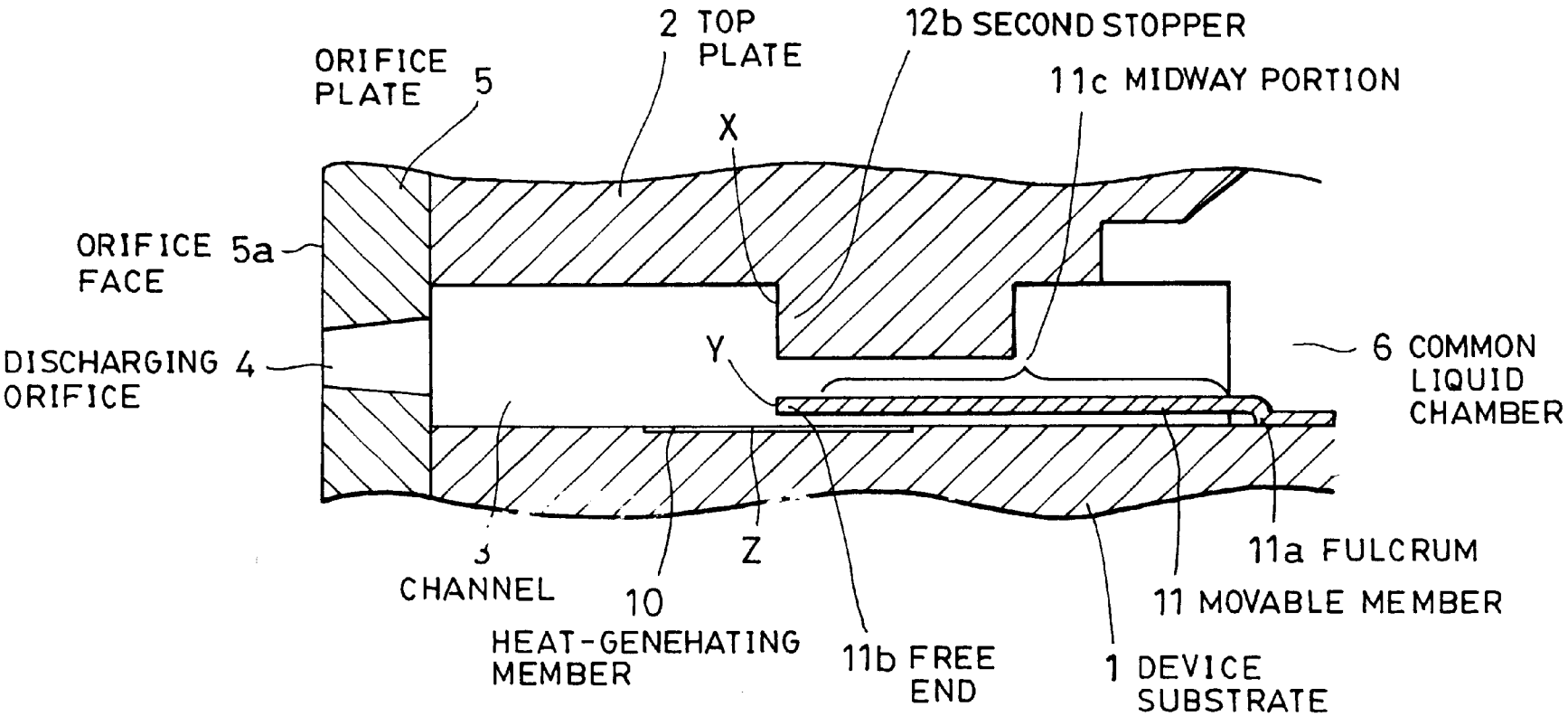
FIG. 1 is a side cross-sectional schematic view of an example of the liquid discharging head according to the present invention.

FIG. 1 is a side cross-sectional schematic diagram of the principal portions of a liquid discharging head with stoppers formed extending backwards. That is, the nozzle shown in FIG. 1 is a side cross-sectional schematic diagram of a nozzle which is contained in a trailing driving block which is driven later than a leading driving block which is driven first and is adjacent to the leading driving block, the nozzle being situated at the boundary between the leading driving block and the trailing driving block.

Also, FIGS. 2A through 2E are a series of diagrams illustrating the discharging process of liquid from the liquid discharging head shown in FIG. 1.

First, the configuration of the liquid discharging head will be described with reference to FIG. 1.

This liquid discharging head has an essentially flat device substrate 1 having heat-generating members 10 which are bubble generating means and movable members 11, a top plate 2 upon which second stoppers with the back end thereof extending in the upstream direction, and an orifice plate 5 with discharging orifices 4 formed thereupon.

Channels 3 through which the liquid flow are formed by the device substrate 1 and top plate 2 being fixed in a layered state. Also, a plurality of the channels 3 are formed on a liquid discharging head in a parallel manner, and connect to the discharging orifices 4 for discharging liquid, formed downstream (to the left in FIG. 1). A bubble generating area exists at an area near a face where a heat-generating member and the liquid come into contact. Also, a common liquid chamber 6 with a great capacity is formed so as to simultaneously communicate with the upstream (to the right in FIG. 1) of the channels 3. In other words, the channels 3 are formed so as to branch off of the single common liquid chamber 6. The height in the liquid chamber of this common liquid chamber 6 is formed so as to be higher than the height in the channel of the channels 3.

The movable member 11 is of a cantilever type supported at one end, fixed to the device substrate 1 at the upstream side of the flow of ink, and is vertically free to move as to the device substrate 1 at the portion further downstream from a fulcrum 11*a*. In the initial state, the movable member 11 is positioned generally parallel to the device substrate 1 while maintaining a gap with the device substrate 1.

The movable member 11 disposed on the device substrate 1 is positioned such that a free end 11*b* is situated at approximately the center area of the heat generating element 10. Also, the second stopper 12*b* provided to the top plate 2 restricts the amount of displacement of the free end 11*b* in the upwards direction by the free end 11*b* of the movable member 11 coming into contact with the second stopper 12*b*. At the time that the amount of displacement of the free end 11*b* is restricted by the movable member 11 coming into contact with the second stopper 12*b* (i.e., in the event that the movable member is in contact), the channel 3 is essentially closed off between the movable member 11 and second stopper 12*b* on upstream, and the movable member 11 and second stopper 12*b* on downstream, by the movable member 11 and the second stopper 12*b*.

Particularly, the second stopper 12*b* according to the present embodiment is of a form with the back side of the second stopper 12*b* extended toward the common liquid chamber 6 such that not only the free end 11*b* of the movable member 11 but also a midway portion 11*c* thereof will come into contact therewith in the event that the free end 11*b* is displaced upwards. Accordingly, the upwards warping of the midway portion 11*c* of the movable member 11 generated by only the area of the free end 11*b* of the movable member 11 coming into contact, is prevented.

A position Y on the free end 11*b* and an edge X of the second stopper 12*b* are preferably situated on a face perpendicular to the device substrate 1. More preferably, these X and Y and further a point Z which is the center of the heat-generating element should be situated on a face perpendicular to the device substrate 1.

Also, the height of the channel 3 downstream from the second stopper 12*b* is of a form which suddenly becomes high. Due to this configuration, the bubble downstream of the bubble generating area is provided with sufficient channel height even when the movable member 11 is restricted by the second stopper 12*b*, so the liquid can be sent toward the discharging orifice 4 in a smooth manner without impeding the growth of the bubble, and also the non-uniformity in the pressure balance in the height direction from the lower edge to the upper edge of the discharging orifice 4 is reduced, so suitable liquid discharging can be performed. Also, with conventional liquid discharging heads not having the movable member 11, assuming such a channel configuration was not preferable since the liquid tends to stagnate at the portion downstream from the second stopper 12*b* which the channel height is high, and bubbles tend to collect in this stagnated part, but with the above-described configuration according to the present embodiment the flow of the liquid reaches this stagnation portion as well, so the effects of residual bubbles becomes extremely small.

In the event that there is no movable member 11 with this configuration, the fluid resistance at the downstream side of the bubble generating area is smaller than the fluid resistance at the upstream side, so pressure used for discharging did not readily head toward the discharging orifice 4, but with the present embodiment, movement of the bubble upstream of the bubble generating area at the time of bubble formation is essentially closed off by the movable member 11, so the pressured used for discharging aggressively heads toward the discharging orifice 4, and also the fluid resistance upstream of the bubble generating area at the time of supplying ink is small so ink is speedily supplied to the bubble generating area.

Providing the movable member 11 means that the growth component of the bubble in the downstream direction and the growth component of thereof in the upstream direction are not uniform, but rather the growth component of the bubble in the upstream direction is small and movement of the fluid in the upstream direction is restricted. Flow of the fluid in the upstream direction being restricted means that the amount of meniscus regression following discharge lessens, so the amount from the meniscus protruding from the orifice face 5*a* at the time of refilling also decreases. Accordingly, meniscus vibrations are suppressed, so stable discharging can be performed at all driving frequencies, from low frequencies to high frequencies.

Also, with the present embodiment, the downstream portion of the bubble and the discharging orifice 4 are in a "linear communicating state" wherein a straight channel configuration is maintained regarding the liquid flow. More preferably, an ideal state is suitably formed wherein the discharging state of the later-described discharged droplets 66 such as the discharging direction and discharging speed thereof are stabilized at an extremely high level, by linearly matching the direction of propagation of pressure waves generated at the time of generating the bubble, and the accompanying liquid flow direction and discharge direction. With the present embodiment, as one definition for achieving or approaching this ideal state, a configuration wherein the discharging orifice 4 and the heat-generating member 10, particularly the discharging orifice 4 side (downstream side) of the heat-generating member 10 which greatly affects the discharging orifice 4 side of the bubble, are directly connected by a straight line, is suitable, meaning that in a state that there is no liquid within the channel 3, the heat-generating member 10, particularly the downstream side of the heat-generating member 10, can be visually observed from the outside of the discharging orifice 4.

Next, the discharging operation of the liquid discharging head according to the present embodiment will be described in detail with reference to FIGS. 2A through 2E. This description of the discharging operation of the liquid discharging head will be made regarding a nozzle wherein a first stopper 12*a* is formed which has a length in the channel direction which is shorter than the second stopper 12*b* and a later-described third stopper 12*c*.

Figure 2A:
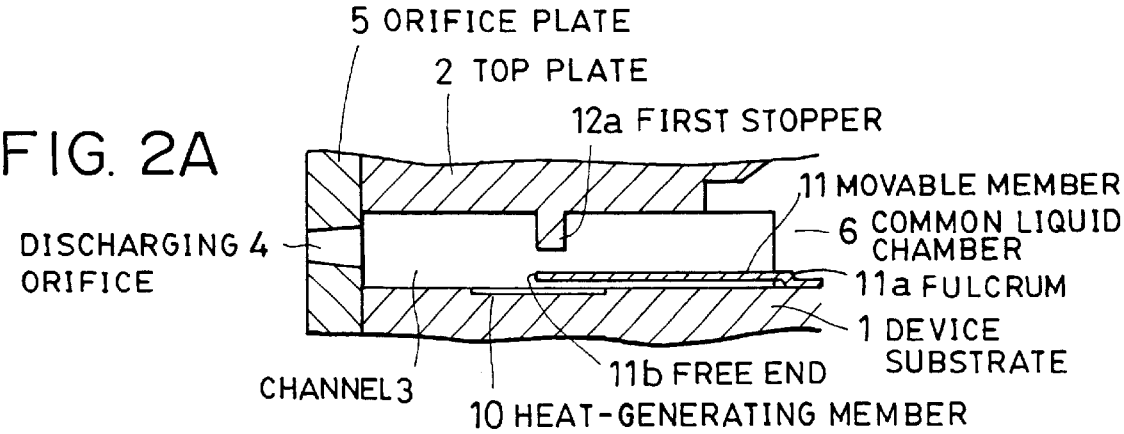
FIGS. 2A through 2E are a series of diagrams illustrating the discharging process of liquid from the liquid discharging head shown in FIG. 1.

FIG. 2A illustrates a state before energy such as electric energy or the like is applied to the heat-generating element 10, i.e., before the heat-generating element 10 generates heat. The movable member 11 is situate at an area facing the upstream half portion of a bubble generated by this heat-generating element 10, as described later.

Figure 2B:
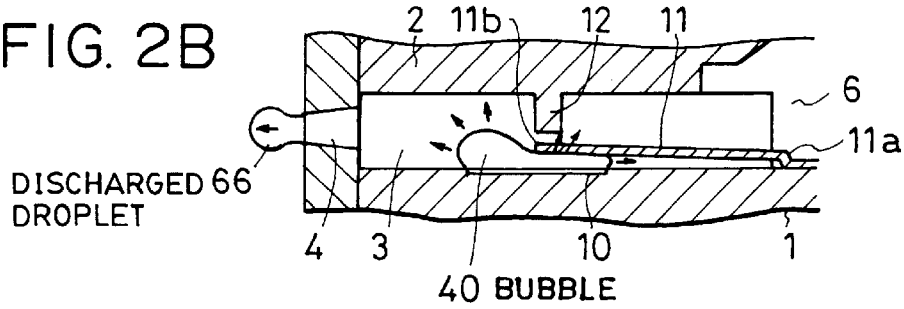

FIG. 2B shows the state of a portion of the liquid filling the bubble generating area being heated by the heat-generating element 10, with a bubble 40 accompanying the film boiling beginning to form. That is to say, pressure waves based on generation of the bubble 40 due to the film boiling are propagated through the channel 3, causing the liquid to move in the downstream side and upstream side, bordering on the center area of the bubble generating area, and at the upstream side, the movable member 11 begins to be displaced due to the flow accompanying the growth of the bubble 40. Also, the movement of the liquid at the upstream side passes between the wall of the channel 3 and the movable member 11 and heads toward the common liquid chamber 6. The clearance between the first stopper 12*a* and the movable member 11 becomes narrower here as the movable member 11 is displaced. In this state, a discharged droplet 66 starts to be discharged from the discharging orifice 4.

Figure 2C:
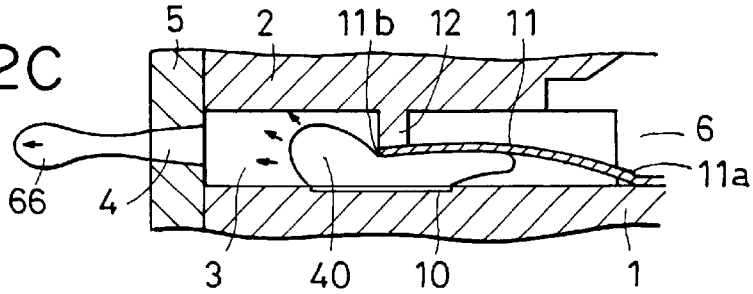

FIG. 2C shows a state wherein the free end 11*b* of the movable member 11 which has been displaced by further growth of the bubble 40 has come into contact with the first stopper 12*a*.

The movable member 11 further draws near to the first stopper 12*a*, and comes into contact therewith, and contact between the movable member 11 and the first stopper 12*a* is secured by the height of the first stopper 12*a* and the clearance between the upper face of the movable member 11 and the tip portion of the first stopper 12*a* being restricted to desired dimensions. Then, one the free end 11*b* of the movable member 11 and the first stopper 12*a* come into contact, further upwards displacement of the free end 11*b* is restricted, so the movement of the liquid in the upstream direction is greatly restricted there. Accordingly, the growth of the bubble 40 in the upstream direction is restricted at the movable member 11. However, the force of movement of the liquid in the upstream direction is great, so the movable member 11 is subjected to great stress pulling in the upstream direction, an thus is deformed in a convex shaped at the middle portion 11*c* thereof in the upwards direction. Note that the bubble 40 is still continuing its growth at this time, but the growth in the upstream direction is restricted by the first stopper 12*a* and the movable member 11 so the growth of the bubble 40 in the downstream direction further continues, so the height of growth of the bubble 40 in the downstream direction from the heat-generating member 10 is greater as compared to arrangements wherein the movable member 11 is not provided.

On the other hand, as described above, the upstream side portion of the bubble 40 is of a small size in a state of doing no more than charging stress for curving the movable member 11 in a convex shaped in the upstream direction by the momentum of the liquid flow in the upstream direction, the displacement of the movable member 11 having been restricted by the first stopper 12*a*. The amount of this upstream side portion of the bubble 40 which enters the upstream area is restricted to almost zero, due to the first stopper 12*a* nozzle wall, movable member 11, and fulcrum 11*a*.

Accordingly, the flow to the upstream side is markedly restricted, and reverse flow of fluid in the supplying channel system and pressure vibrations, which inhibit high-speed refilling, is prevented.

Figure 2D:
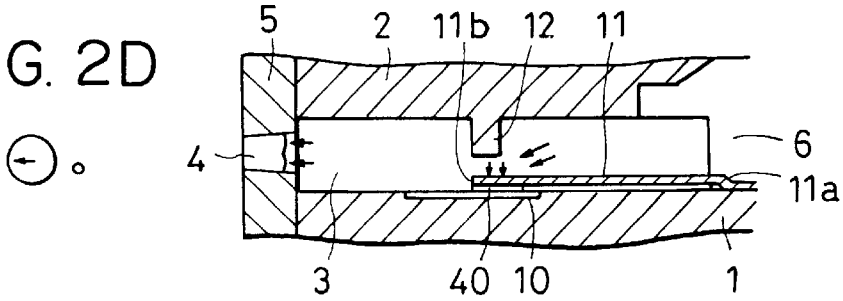

FIG. 2D illustrates a state wherein the negative pressure within the bubble 40 following the above-describe film boiling overcomes the movement of the fluid in the downstream direction within the channel 3, and wherein the bubble 40 has started to reduce.

The movable member 11 begins downward displacement accompanying the shrinking of the bubble 40, and the movable member 11 itself has the stress of the cantilever spring and the stress of the upward convex deformation, and thus the downward displacement speed is increased. The flow of liquid toward the downstream side upstream of the movable member 11 which is a low-channel-resistance area formed between the common liquid chamber 6 and the channel 3 rapidly becomes a great flow since the channel resistance is small for flows of liquid in the downstream direction, and flows to the channel 3 via the first stopper 12*a*. The liquid is guided into the channel 3 from the common liquid chamber 6 due to these actions. The liquid guided into the channel 3 passes between the first stopper 12*a* and the downwards-displaced movable member 11 without change, and flows to the downstream side of the heat-generating member 10, while also acting to accelerate dissipation the part of the bubble 40 which has not completely dissipated. Following aiding in this bubble dissipation, the flow of liquid further creates a flow in the direction of the discharging orifice 4, aids in meniscus recovery, and improves refill speed.

At this stage, the liquid column made up of the discharged droplet 66 exiting from the discharging orifice 4 becomes a liquid droplet and flies externally.

Also, the flow into the channel 3 from between the movable member 11 and the first stopper 12*a* as described above increases the flow speed at the wall face of the top plate 2, so there are very few residual minute bubbles and the like, thereby contributing to stability of discharging.

Further, the cavitation generating point due to the bubble dissipating shifts to the downstream side of the bubble generating area, so damage to the heat-generating member 10 is lessened. At the same time, scorching at the heat-generating member 10 area due to the same phenomena also decreases, thereby improving discharging stability.

Figure 2E:
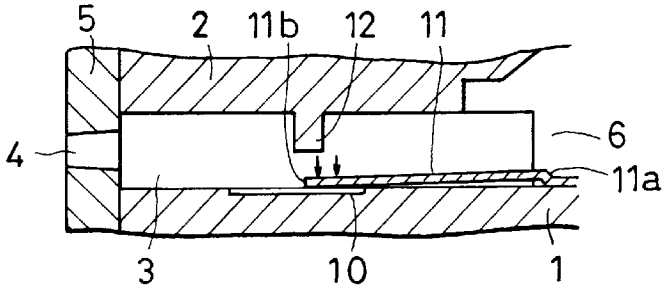

FIG. 2E illustrates a state wherein, following complete dissipating of the bubble 40, the movable member 11 has overshot the initial state downwards and is thus displaced.

The overshooting of this movable member 11, while depending on the rigidity of the movable member 11 and the viscosity of the liquid used, decays and converges in a short time, and returns to the initial state.

Figure 3:
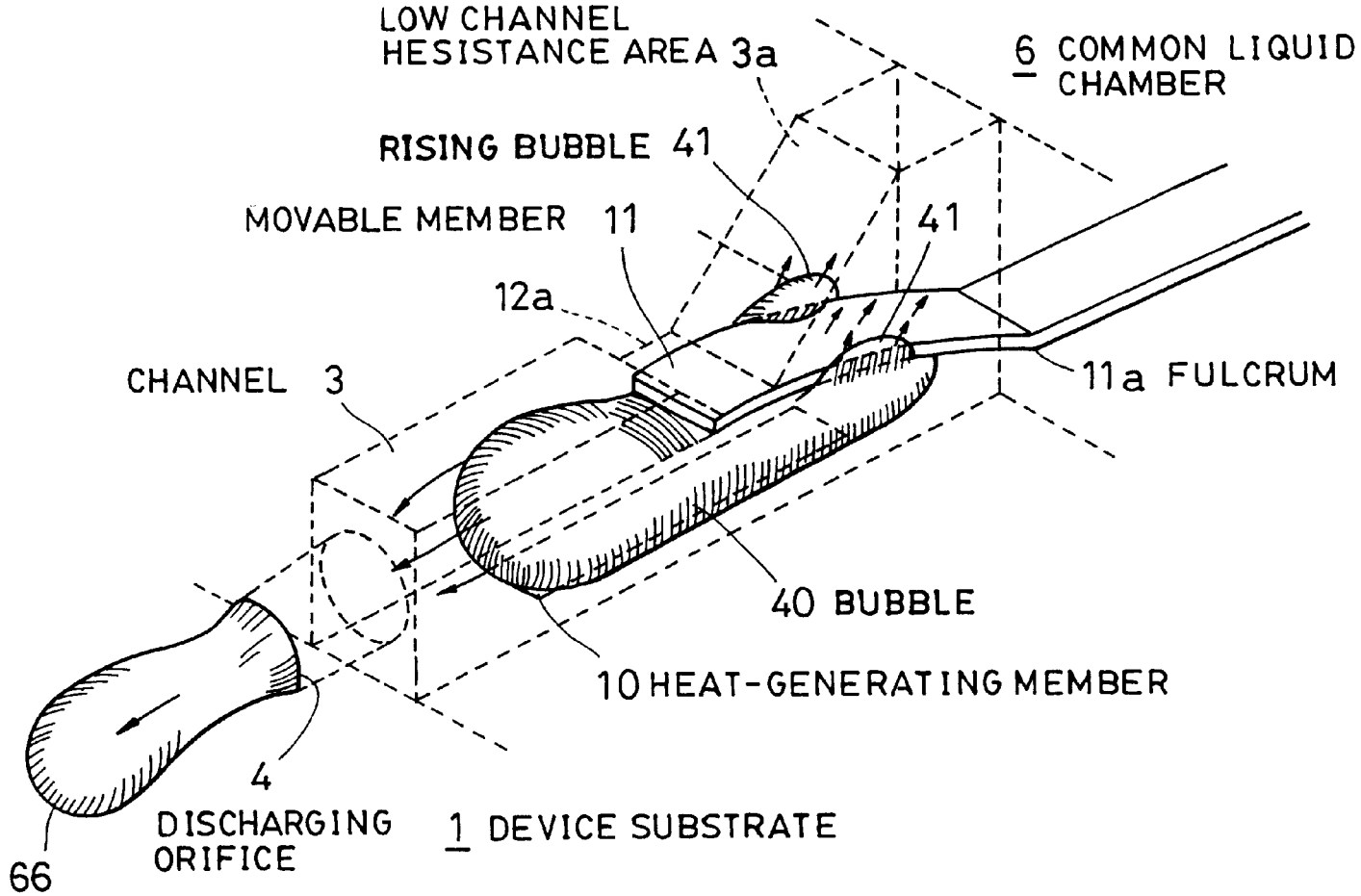
FIG. 3 is an opened-up perspective view of a portion of the head shown in FIG. 1.

Next, description will be made in detail regarding in particular the rising bubble 41 rising from both side portions of the movable member 11, and the meniscus of the liquid at the discharging orifice 4, with reference to FIG. 3 which is an opened-up perspective view of a portion of the head shown in FIG. 1. Note that while the form of the first stopper 12*a* and the form of the low-channel-resistance area 3*a* upstream from the first stopper 12*a* shown in FIG. 3 are different from that shown in FIG. 1, but the basic properties are the same.

With the present embodiment, a slight clearance exists between both sides portions of the moveable member 11 and both side walls making up the channel 3, thereby facilitating smooth displacement of the moveable member 11. Further, in the growth process of the bubble die to the heat-generating element 10, the bubble 40 displaces the moveable member 11, and also rises to the upper side of the moveable member 11 through the clearance and slightly intrudes into the low-channel-resistance area 3*a*. This rising bubble 41 which has intruded therein passes around to the back side of the moveable member 11 (i.e., the opposite side as to the bubble generating area), thereby suppressing unwanted motion of the moveable member 11 and stabilizing discharging properties.

Further, in the dissipation process of the bubble 40, the rising bubble 41 promotes flow from the low-channel-resistance area 3*a* to the bubble generating area, and in cooperation with the high-sped meniscus retraction from the discharging orifice 4 side described above, promptly completes bubble dissipation. Particularly, there are hardly any bubbles residing in the corners of the movable member 11 and channel 3, due to the flow generated by the rising bubble 41.

Thus, according to the liquid discharging head having the above-described configuration, at the instant that liquid is discharged from the discharging orifice 4 due to generation of the bubble 40, the discharged droplet 66 is of a form close to that of a column having a spherical portion at the tip thereof. This is true with conventional head arrangements as well, but with the present invention, the movable member 11 is displaced by the growing process of the bubble, and at the point that this displaced movable member 11 comes into contact with the first stopper 12*a*, an essentially closed-off space is formed in the channel 3 having the bubble generating area, except for the discharging orifice. Accordingly, dissipating the bubble in this state means that the above closed-off state is maintained until the movable member 11 departs from the first stopper 12*a* by the bubble dissipation, so almost all of the energy of the bubble 40 dissipating acts as a first to move the liquid near the discharging orifice in the upstream direction. Consequently, immediately following starting of bubble dissipation of the bubble 40, the meniscus is rapidly drawn into the channel 3 from the discharging orifice 4, and the tailing portion connecting to the discharged droplet 66 outside the discharging orifice 4 forming a liquid column is speedily severed by the powerful force of the meniscus. Thus, satellite dots formed by the tailings portion become small, and recording quality can be improved.

Further, the fact that the tailing portion is not pulled by the meniscus for a long time means that the discharging speed does not drop, and the distance between the discharged droplet 66 and the satellite dots is closer, so the satellite dots are drawn to the discharged droplet 66 from behind, due to the so-called slipstream phenomena. Consequently, the discharged droplet 66 and the satellite dots may even join, thereby enabling a liquid discharging head with almost no satellite dots to be provided.

Further, with the above embodiment, in the above-describe liquid discharging head, the movable member 11 is provided for restricting only the bubble 40 which grows in the upstream direction, with regard to the flow of liquid heading toward the discharging orifice 4. More preferably, the free end 11*b* of the movable member 11 is situated at the essentially center portion of the bubble generating area. According to this configuration, back waves in the upstream direction due to growth of the bubble and also momentum of the liquid, which are not directly related to discharging of the liquid, can be suppressed, and the growth component of the bubble 40 in the downstream direction can be headed toward the discharging orifice 4 without other complicating factors.

Further, since the channel resistance of the low-channel-resistance area 3*a* at the opposite side of the discharging orifice 4 across the first stopper 12*a* is low, the movement of the liquid in the upstream direction due to the growth of the bubble 40 becomes a great flow due to the low-channel-resistance area 3*a*, so at the point that the displaced movable member 11 comes into contact with the first stopper 12*a*, the movable member 11 is subjected to stress pulling in the upstream direction. Consequently, even after the bubble dissipation starts, the force of the liquid moving in the upstream direction due to the growth of the bubble 40 remains great, so the above closed-off space can be maintained for a certain amount of time, till the reactive force of the movable member 11 overcomes this force of moving liquid. That is to say, due to this configuration high-speed meniscus retracting is even more sure. Also, when the bubble dissipating process of the bubble 40 progresses and the reactive force of the movable member 11 overcomes the force of the liquid moving in the upstream direction due to the bubble growth, the movable member 11 is displaced downwards in an attempt to return to the initial state, and accordingly a downstream flow is generated even at the low-channel-resistance area 3*a*. The resistance for the downstream flow at the low-channel-resistance area 3*a* is small, so the flow rabidly becomes a great flow and flows into the cannel 3 via the first stopper 12*a*. Consequently, the above meniscus retraction is speedily stopped by the downstream liquid flow toward the discharging orifice 4, thereby converging the meniscus vibrations at high speed.

Next, description will be made regarding block driving of the liquid discharging head according to the present embodiment.

Figure 4:
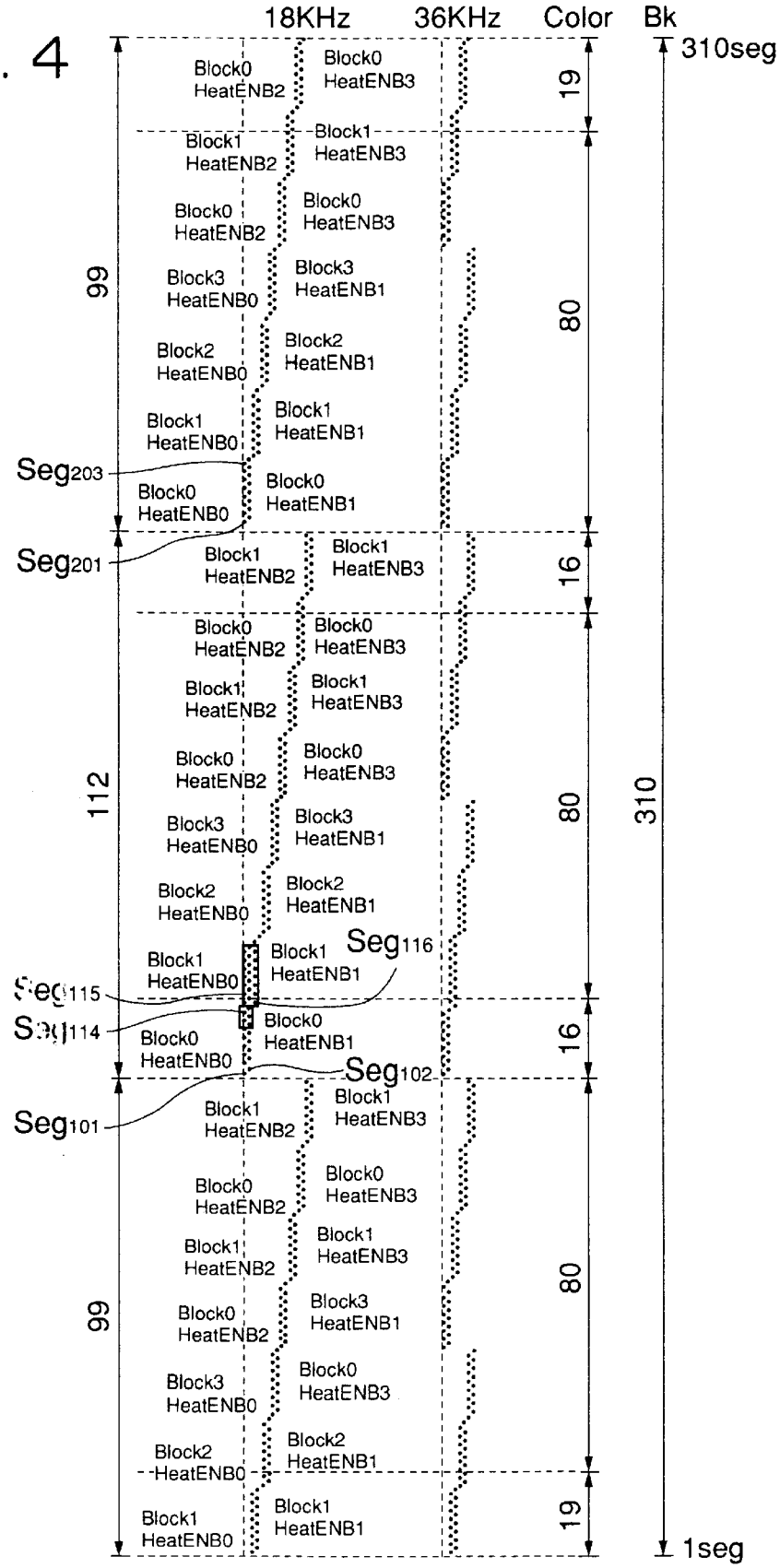
FIG. 4 is a timing chart describing the array or the discharging orifices and the block sectioning of the discharging orifices of the liquid discharging head according to an embodiment.

FIG. 4 shows a timing chart for describing the discharging timing and the discharge orifice block sectioning of the liquid discharging head according to the present embodiment.

The liquid discharging head according to the present embodiment comprises 310 heat-generating members 10, and as shown in FIG. 4, is driven in three columns, generally divided, in the event of driving at 18 kHz, and is driven in six columns, generally divided, in the event of driving at 36 kHz. With such a driving method, the discharge orifice rows of the liquid discharging head are suitably scanned having a 3-dot/300-dot inclination in the longitudinal direction.

The following description will be made with regard to a case wherein driving is performed at 18 kHz, i.e., wherein the discharging time interval of one discharging orifice is approximately 55.5 $\mu$s.

The 310 heat-generating members 10 appropriated with segment Nos. Seg 1 through Seg 310 are grouped into 16 groups of heat-generating members 10 with the same driving timing, this number 16 being obtained by the number of combinations between the four heat enable signals HeatENB 0 through 3 and the four block enable singals BlockENB 0 through 3 (i.e., 4×4=16).

Figure 5:
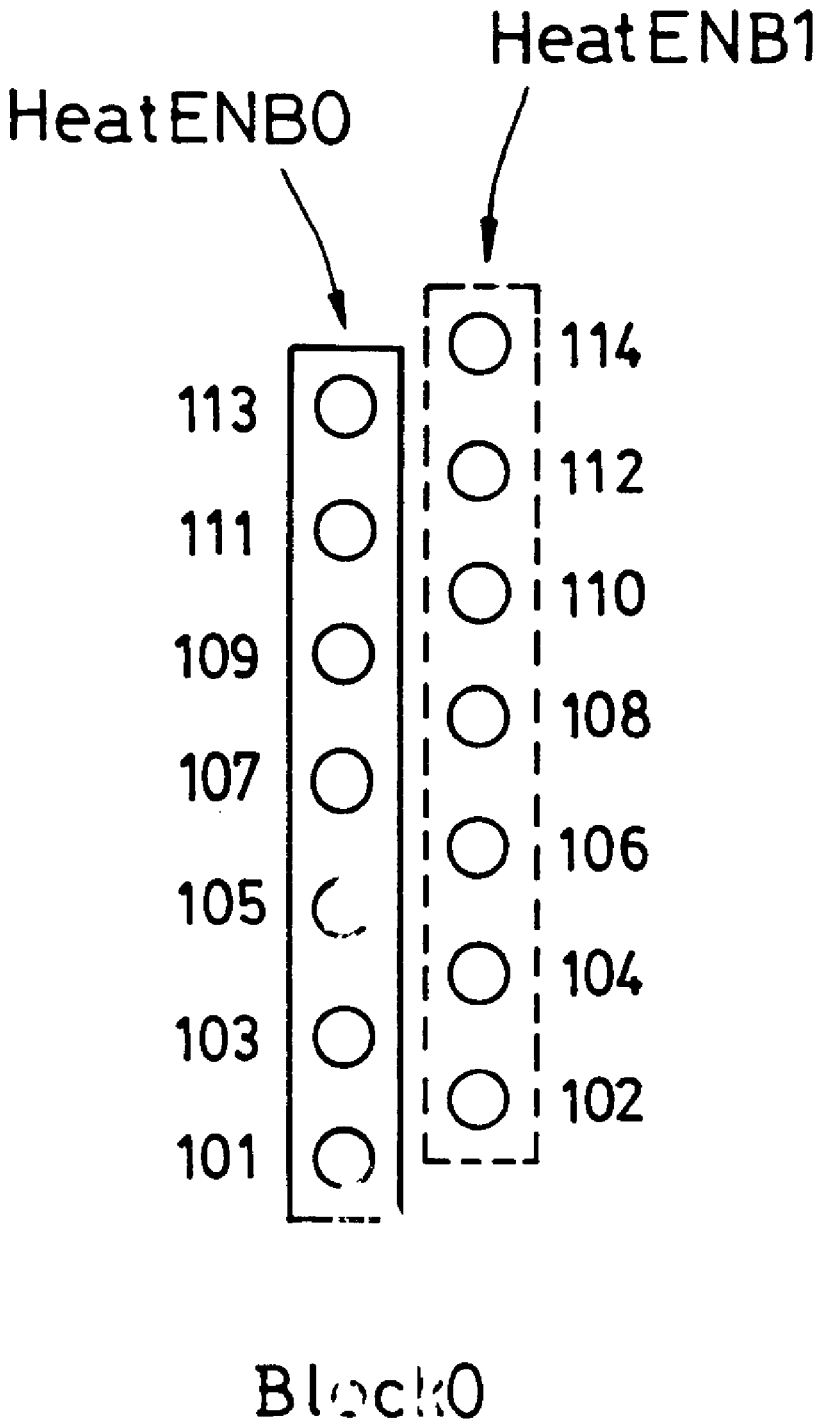
FIG. 5 is an enlarged view of a block shown in FIG. 4.

As shown in FIG. 5 which is an enlarged schematic diagram of the discharging orifices corresponding to the heat-generating members which are driven by the combination of BlockENB0 and HeatENB0, and BlockENB0 and HeatENB1, the seven heat-generating members 10 Seg 101, 103, 105, 107, 109, 111, and 113 are a group which are simultaneously driven by the combination of BlockENB0 and HeatENB0, and the seven heat-generating members 10 Seg 102, 104, 106, 108, 110, 112, and 114 are a group which are simultaneously driven by the combination of BlockENB0 and HeatENB1.

In the event that ink is to be discharged with the combination of BlockENB0 and HeatENB0 for example, ink is discharged from not only the seven nozzles corresponding to Seg 101, 103, 105, 107, 109, 111, and 113, but also from the seven nozzles corresponding to Seg 201, 203, 205, 207, 209, 211, and 213 as well, as shown in FIG. 4.

Next, the block circuit diagram shown in FIG. 6 of the head driver 407 for driving the liquid discharging head (see FIG. 12) will be described.

A shift register 410 temporarily stores serial signals serving as optimal pulse width information stored in ROM 403 (see FIG. 12) which is optimal the pulse width for driving pulses to be applied to the heat-generating members 10, as parallel data for the heat-generating members 10.

Also, an image information data storing shift register 410 temporarily stores as parallel data, serial signals serving as image information turning the heat-generating members 10 on and off according to the image information. The image information data output from this image information data storing shift register 410 is held by a latch 411 according to latch signals The number of pulse generators 412, which receive input of optimal pulse width information, image information data, HeatENB 0 through 3, and BlockENB 0 through 3, is the same as that of the heat-generating members 10, and the pulse generators 412 are configured so as to be capable of driving any of the above 16 groups by receiving input of one of the 16 combinations of HeatENB 0 through 3 and BlockENB 0 through 3.

Figure 6:
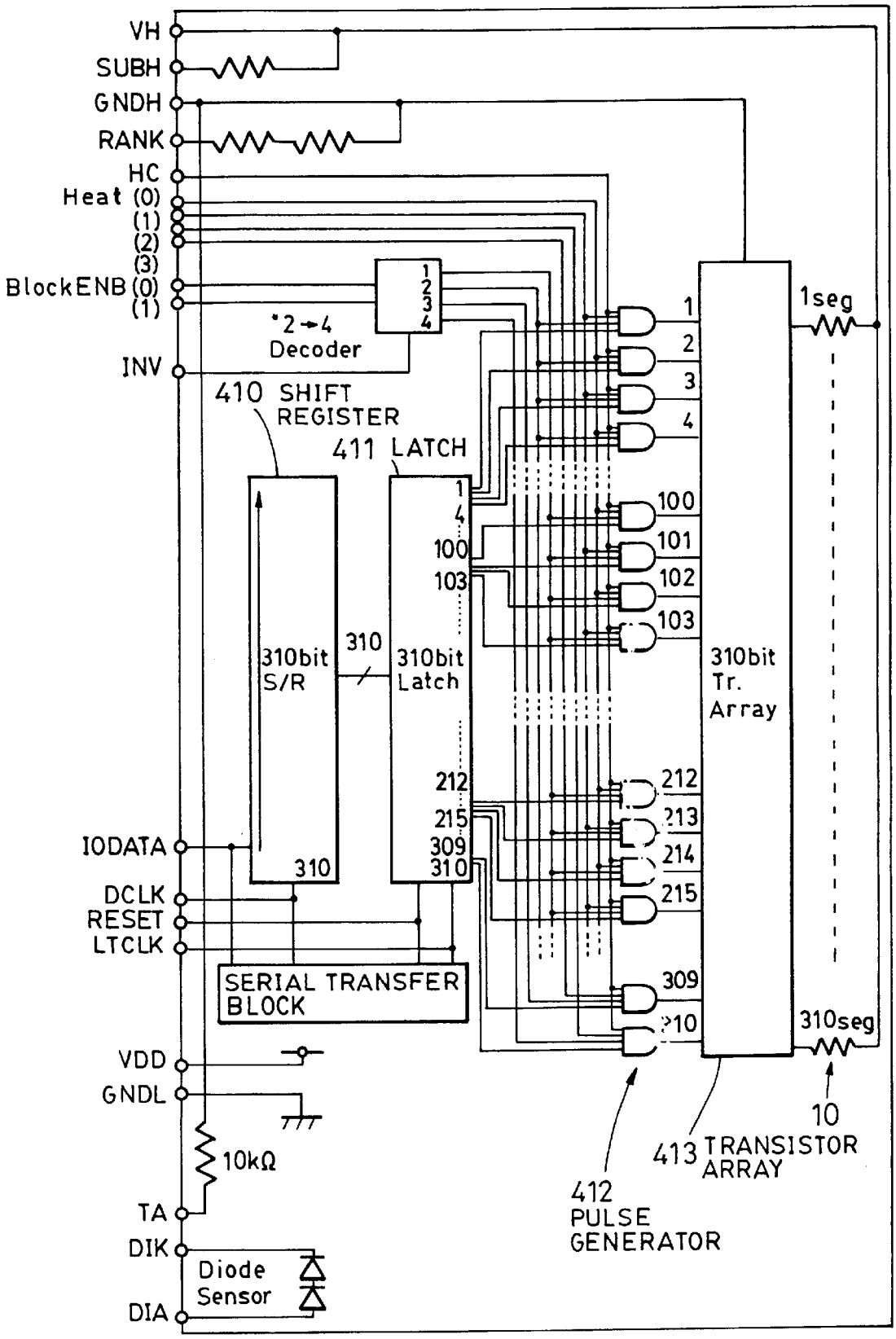
FIG. 6 is an example of a block circuit diagram for carrying out block driving according to the present invention.

That is to say, the block circuit shown in FIG. 6 is configured so as to output optimal waveform pulses from the pulse generators 412 according to the AND of the optimal pulse width information output from the shift register 410, the image information data output from the latch 411, the heat enable signals HeatENB 0 through 3, and the four block enable singals BlockENB 0 through 3, further amplifies these driving pulses with a transistor array 413 formed of 310-bit transistor array, and applies these to the heat-generating elements 10 of one of the above 16 groups, thereby carrying out block driving.

Figure 7:
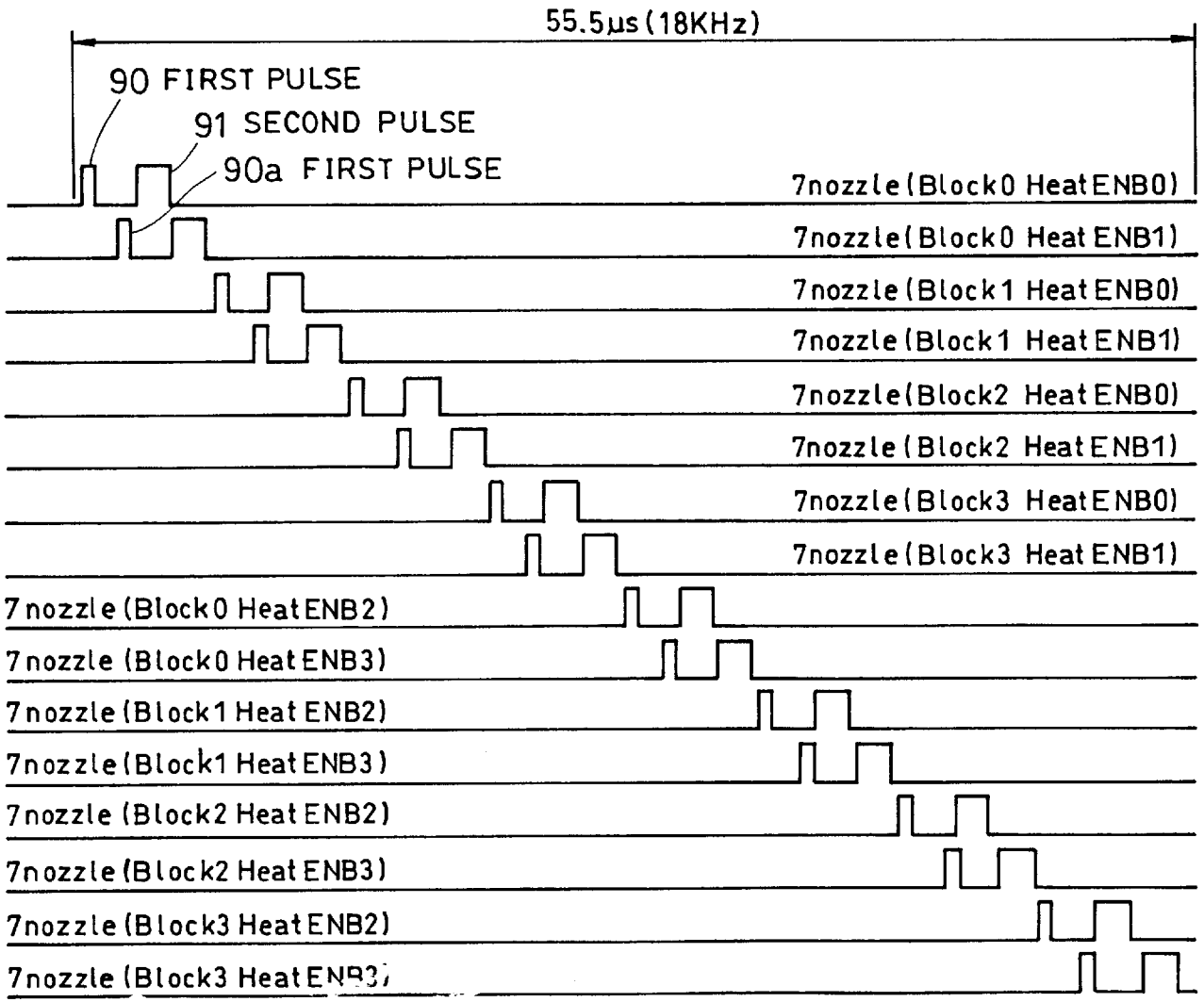
FIG. 7 is a timing chart illustrating driving waveforms output from a pulse generator at the time of driving.

As shown in FIG. 7, the heat-generating elements 10 according to the present embodiment divided into 16 groups are applied with double-pulse driving pulses from the pulse generators 412, made up of a first pulse 90 and a second pulse 91. The double pulses are made up of a first pulse 90 for preheating the ink and a second pulse 91 for discharging the ink from the nozzle in order to stabilize the discharging properties. Also, the double-pulse method according to the present embodiment is a nested double-pulse method wherein, for example, a first pulse 90*a* corresponding to a combination of BlockENB0 and HeatENB1 is applied between the first pulse 90 and the second pulse 91 corresponding to the combination of BlockENB0 and HeatENB0.

Next, the behavior of ink within near-boundary nozzles of a trailing driving block that has not been driven positioned near the boundary with a leading driving block that has been driven will be described with reference to the plan cross-sectional view shown in FIG. 8, and the behavior of the movable members will be described with reference to the side cross-sectional view shown in FIG. 9.

Figure 8:
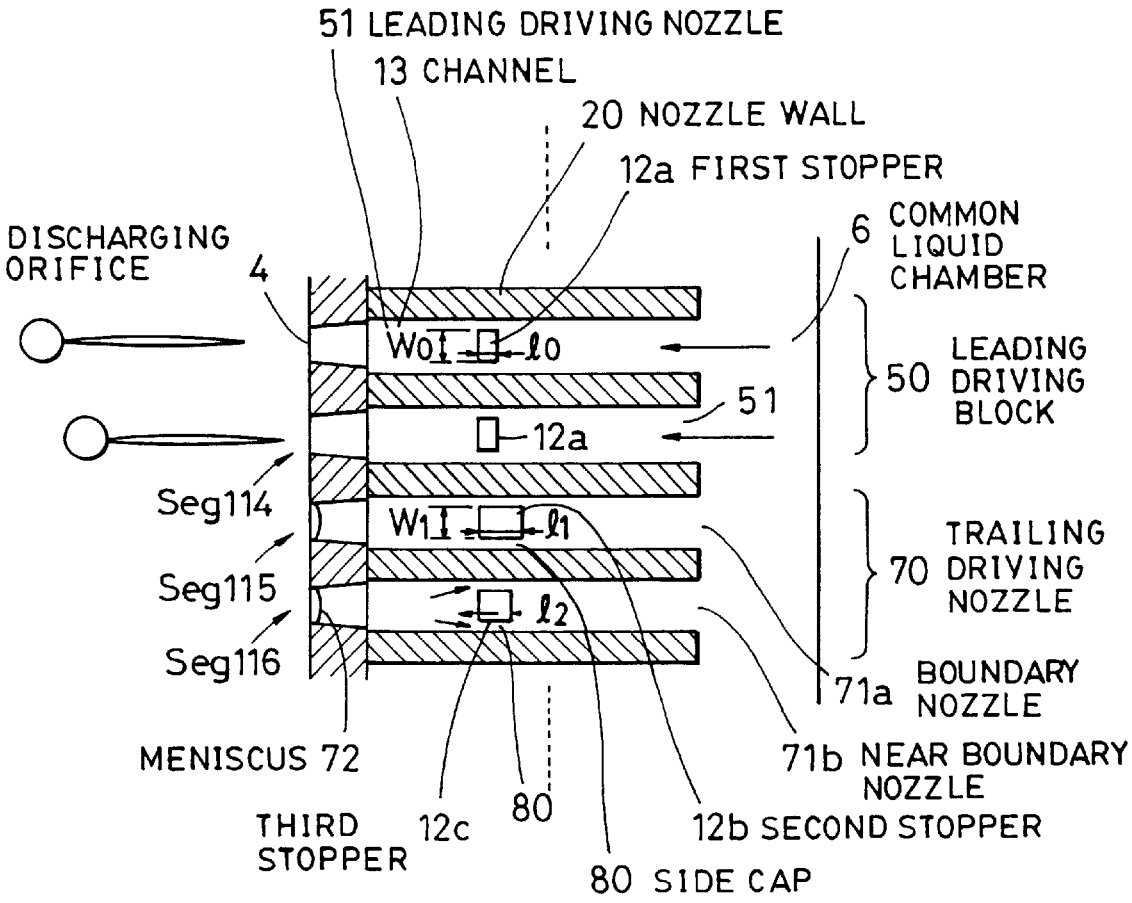
FIG. 8 is a plan cross-sectional for describing the behavior of ink within near-boundary nozzles near the boundary with a block that has been driven and the behavior of the movable member.

FIG. 8 schematically illustrates the state immediately following a droplet having been discharged from the discharging orifice 4 of a leading driving nozzle 51 of a leading driving block 50 that has been driven. Note that FIG. 8 does not show the heat-generating members or movable members, for the sake of simplicity. Also, the leading driving nozzle 51, boundary nozzle 71*a*, and near-boundary nozzle 71*b*, shown in FIG. 8, are equivalent to Seg 114, 115, and 116, in FIG. 4. The term "boundary nozzle" means a nozzle adjacent to the border of a driving block, the term "near-boundary nozzle" means a nozzle adjacent to the boundary nozzle in the same driving block as the boundary nozzle.

A first stopper 12*a* of a flow direction length $l_0$ which is the length in the direction of flow of liquid, is provided within the leading driving nozzle 51 of the leading driving block 50. Also, a second stopper 12*b* of a flow direction length $l_1$ which is longer than the flow direction length $l_0$ of the first stopper 12*a* is provided within boundary nozzle 71*a* contained in a trailing driving block 70 which is not driven at the time of the leading driving block 50 being driven but is driven following completing of driving of the leading driving block 50, the boundary nozzle 71*a* positioned at the border with the leading driving block 50. Also., a third stopper 12*c* of a flow direction length $l_2$ which is longer than the flow direction length $l_0$ of the first stopper 12*a* but is shorter than the flow direction length $l_1$ of the second stopper 12*b*, is provided within a near-boundary nozzle 71*b* adjacent to the boundary nozzle 71*a*.

That is, the arrangement is set such that the flow resistance of the second stopper 12*b* and the third stopper 12*c* regarding the flow of the liquid from the discharging orifice 4 side toward the common liquid chamber 6 side is greater than that of the first stopper 12*a*, and also such that the flow resistance of the third stopper 12*c* is greater than that of the first stopper 12*a* but smaller than that of the second stopper 12*b*. Accordingly, supply of liquid into the leading driving nozzle 51 following the leading driving block 50 being driven by the above-described block control and liquid within the leading driving nozzle 51 being discharged from the discharging orifice 4, is chiefly supplied from the common liquid chamber 6, and liquid within the boundary nozzle 71*a* and within the near-boundary nozzle 71*b* being drawn into the leading driving nozzle 51 is greatly suppressed with this configuration. Also, with the near-boundary nozzle 71*b* which is farther from the leading driving block 50 as compared to the boundary nozzle 71*a* is subjected to smaller effects of the drawing of liquid at the time of supplying liquid to the leading driving nozzle 51 of the leading driving block 50 as compared to that of the boundary nozzle 71*a*, sufficient effects of suppressing liquid from being drawn into the leading driving nozzle 51 can be obtained even in the event that the flow resistance of the third stopper 12*c* is smaller than flow resistance of the second stopper 12*b*, as described above.

Figure 9:
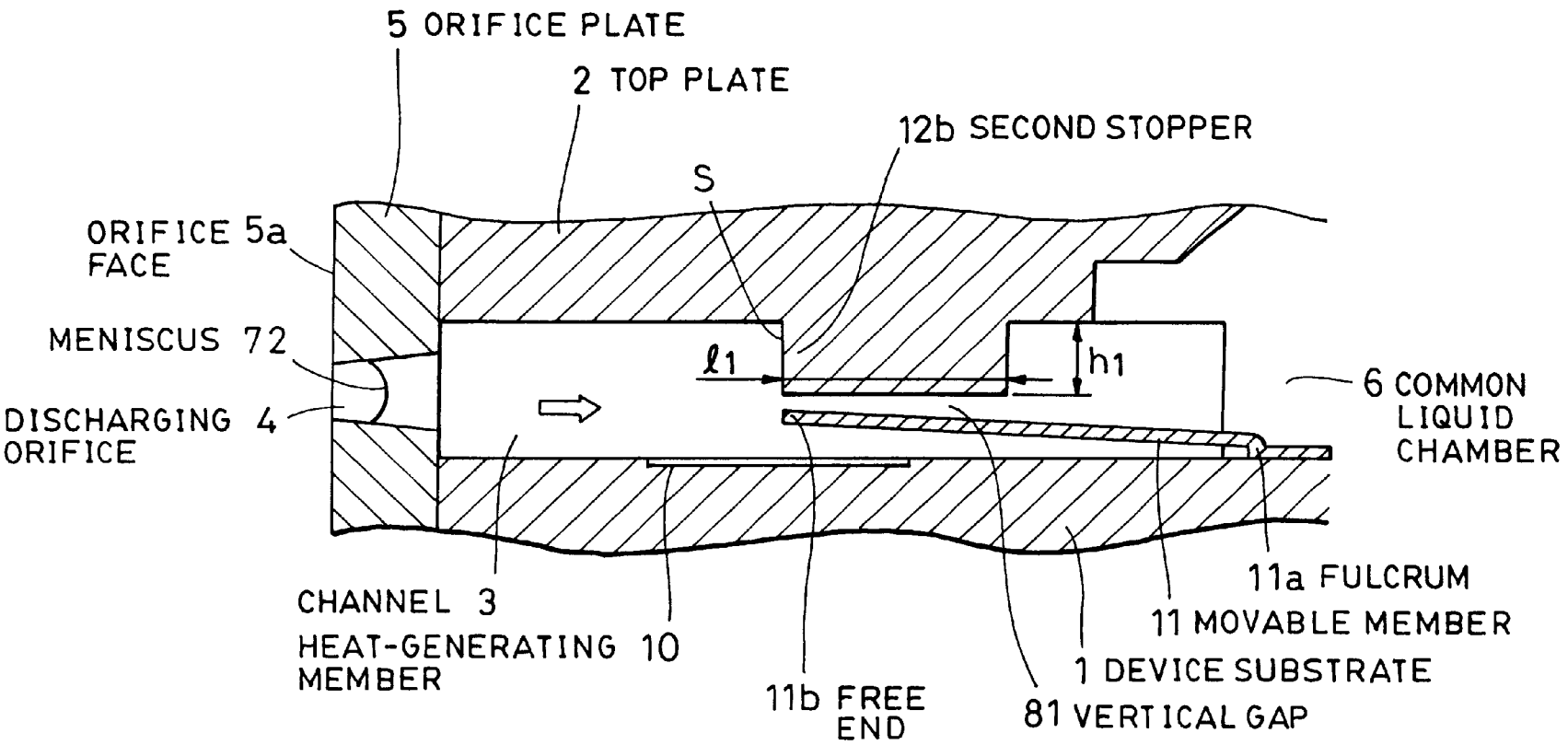
FIG. 9 is a side cross-sectional for describing the behavior of ink within near-boundary nozzles near the boundary with a block that has been driven and the behavior of the movable member.

Also, as shown in FIG. 9, the flow direction length of a vertical-direction gap 81 formed by the second stopper 12*b* and the movable member 11 is of course longer than that formed by the first stopper 12*a* and the movable member 11, so as to be of a configuration wherein flow resistance increases. It is needless to mention that the flow direction length of the vertical-direction gap formed by the third stopper 12*c* and the movable member 11 is longer than that formed by the first stopper 12*a* and the movable member 11, so as to be of a configuration wherein flow resistance increases.

As described above, at the time of driving the leading driving block 50, at the boundary nozzle 71*a* and the near-boundary nozzle 71*b*, liquid existing between the discharging orifices 4 and the second stopper 12*b* and third stopper 12*c* does not readily flow toward the common liquid chamber 6, due to the resistance of the second stopper 12*b* and the third stopper 12*c*. Accordingly, great regression of the meniscus 72 of the discharging orifices 4 of the boundary nozzle 71*a* and the near-boundary nozzle 71*b* can be suppressed.

Figure 10:
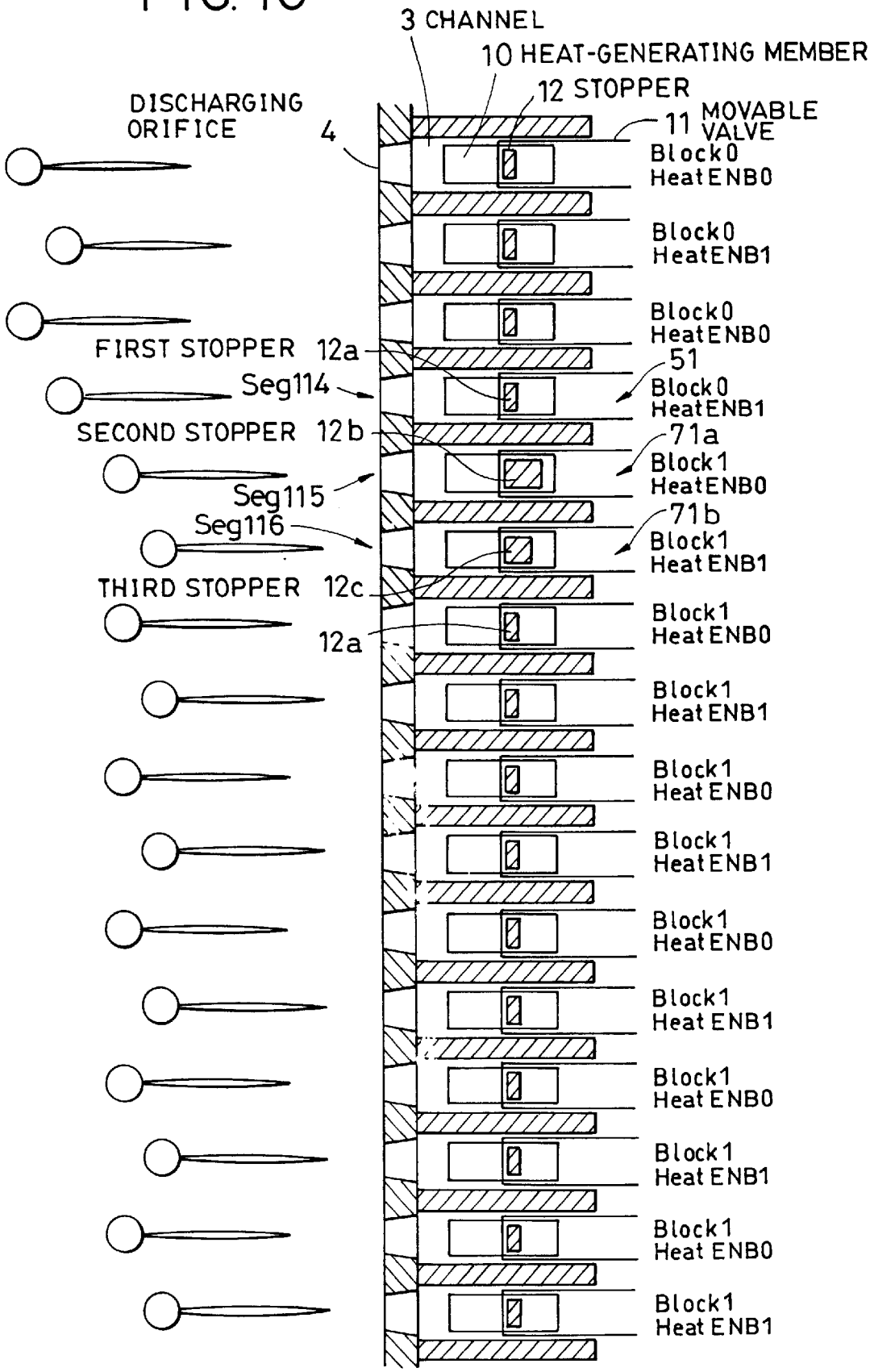
FIG. 10 is a diagram schematically illustrating the discharging amount and discharging speed of ink discharged from the liquid discharging head according to the present invention.
Figure 11:
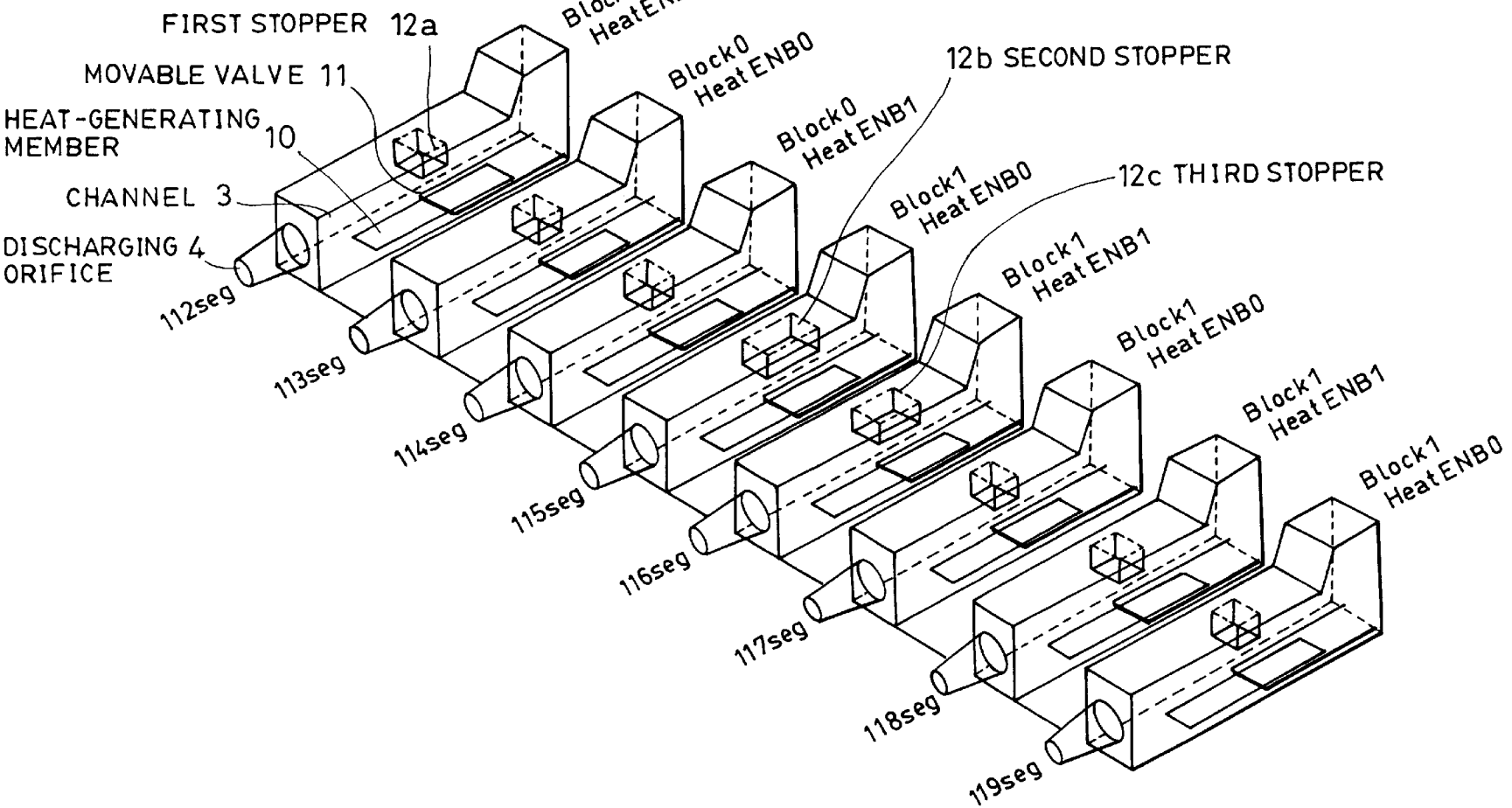
FIG. 11 is a perspective view of the liquid discharging head shown in FIG. 10.

As regression of the meniscus 72 has been suppressed, the size of the main droplet of the liquid discharged from the boundary nozzle 71*a* and the near-boundary nozzle 71*b* can be made to be approximately the same as that of the main droplet of the liquid discharged from the leading driving nozzle 51 as shown in FIG. 10, and accordingly the problem of irregularities in recording between blocks due to regression of the meniscus owing to liquid being drawn out of the channels, can be solved.

The stoppers of nozzles of the trailing driving block 70 other than the boundary nozzle 71*a* and the near-boundary nozzle 71*b* may be the same shape as the first stopper 12*a*.

Further, the shape of the second stopper 12*b* and the third stopper 12*c* may basically be any shape, as long as the flow resistance from the discharging orifice 4 side toward the common liquid chamber 6 side is greater than that of the first stopper 12*a*. For example, an arrangement may be made wherein the dimensions of the second stopper 12*b* and the third stopper 12*c* are greater than the first stopper 12*a*. With the above second stopper 12*b* as an example, this may be achieved by the frontal projection area S of the second stopper 12*b* as viewed from the discharging orifice 4 side as shown in FIG. 9 being greater than the frontal projection area of the first stopper 12*a*, or the height $h_1$ of the second stopper 12*b* may be made to be higher than the height of the first stopper 12*a*, instead of the above-described arrangement wherein the flow direction length is made to be longer. Also, as shown in FIG. 8, the width $w_2$ of the second stopper 12*b* may be made to be wider than the width $w_0$ of the first stopper 12*a*. Making the height $h_1$ higher or the width $w_2$ wider of the second stopper 12*b* means, in other words, that the configuration may be such that the gap between the second stopper 12*b* and the nozzle wall 20 is narrower than the gap between the first stopper 12*a* and the nozzle wall 20.

Moreover, these shapes may be combined.

The following is a description of an example of a liquid discharging apparatus serving as a recording apparatus using the above-described liquid discharging head.

Figure 12:
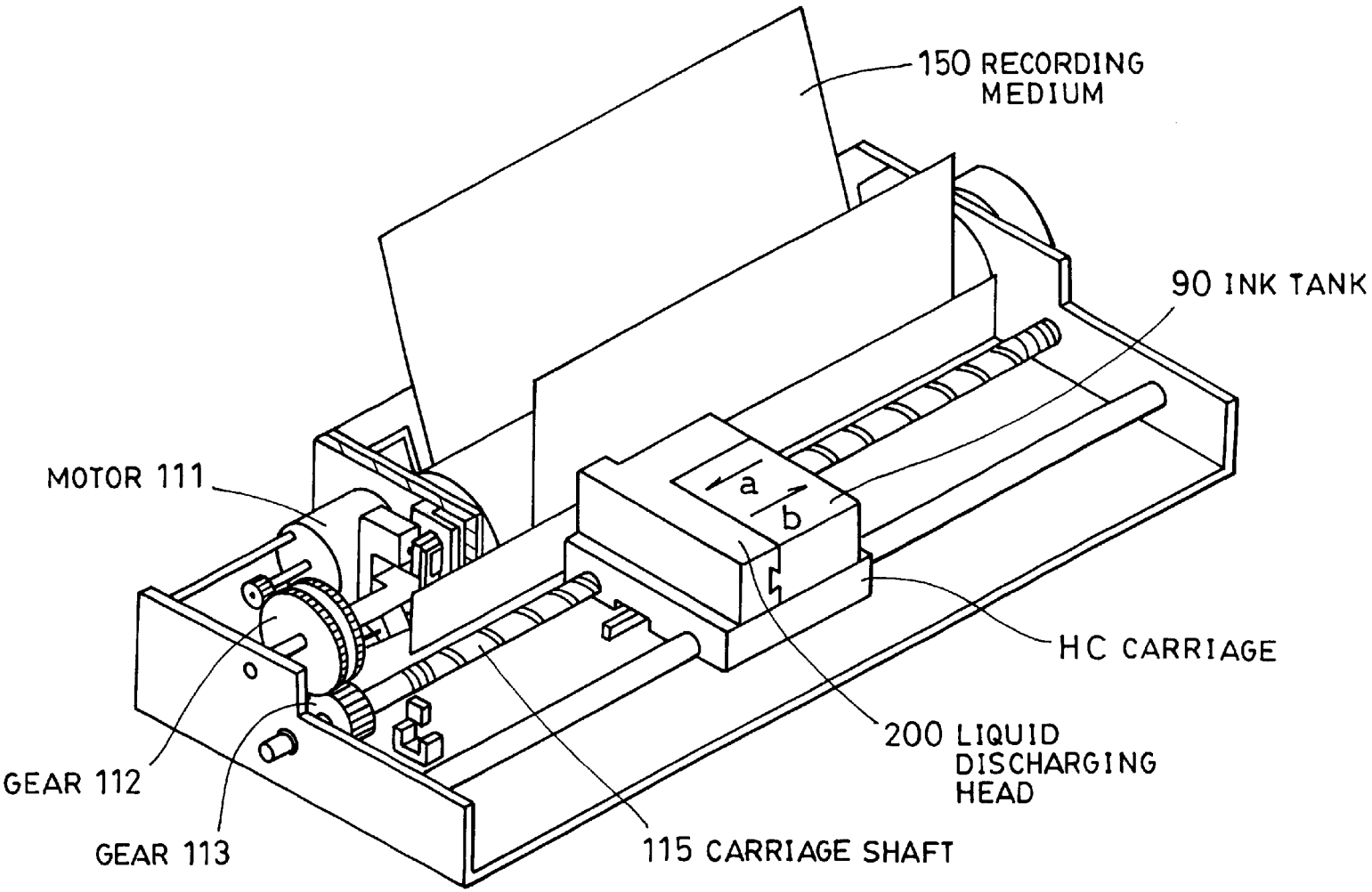
FIG. 12 is a schematic perspective view illustrating an example of the recording apparatus according to the present invention.

FIG. 12 is a schematic perspective view illustrating an example of a liquid discharging apparatus having the above-described liquid discharging head assembled therein and using ink as the discharging liquid. A carriage HC has mounted thereupon a detachable head cartridge carrying a liquid tank unit 90 storing ink and a liquid discharging head 200, and reciprocally moves in the width direction over a recording medium 150 such as recording paper transported by recording medium transporting means.

At the point that the above block driving signals are supplied from unshown driving signals supplying means to the liquid discharging means on the carriage HC, ink (the recording liquid) is discharged from the discharging orifices 4 of the liquid discharging head 200 to the recording medium, according to the signals.

Also, the liquid discharging apparatus according to the present embodiment comprises a motor 111 serving as a driving source for driving the recording medium transporting means and the carriage HC, gears 112 and 113 for transmitting the motive force from the driving source to the carriage HC, a carriage shaft 115, and so forth. Tests showed that suitable recorded images could be obtained by discharging liquid onto various types of recording media by using this liquid discharging apparatus and the liquid discharging method performed with this liquid discharging apparatus.

Figure 13:
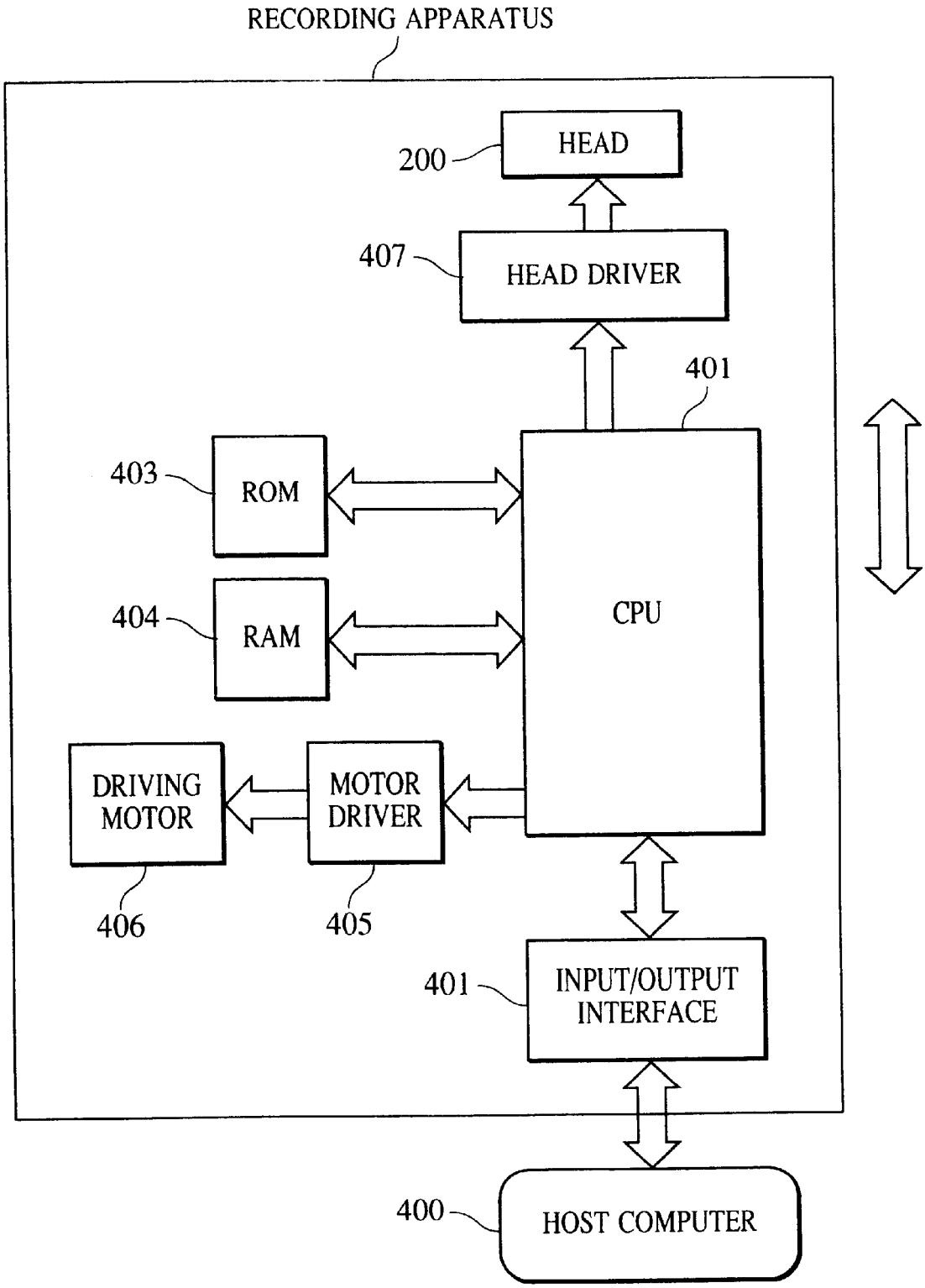
FIG. 13 is a block diagram of the entire recording apparatus for performing ink-jet recording with the liquid discharging head according to the present invention.
Figure 14:
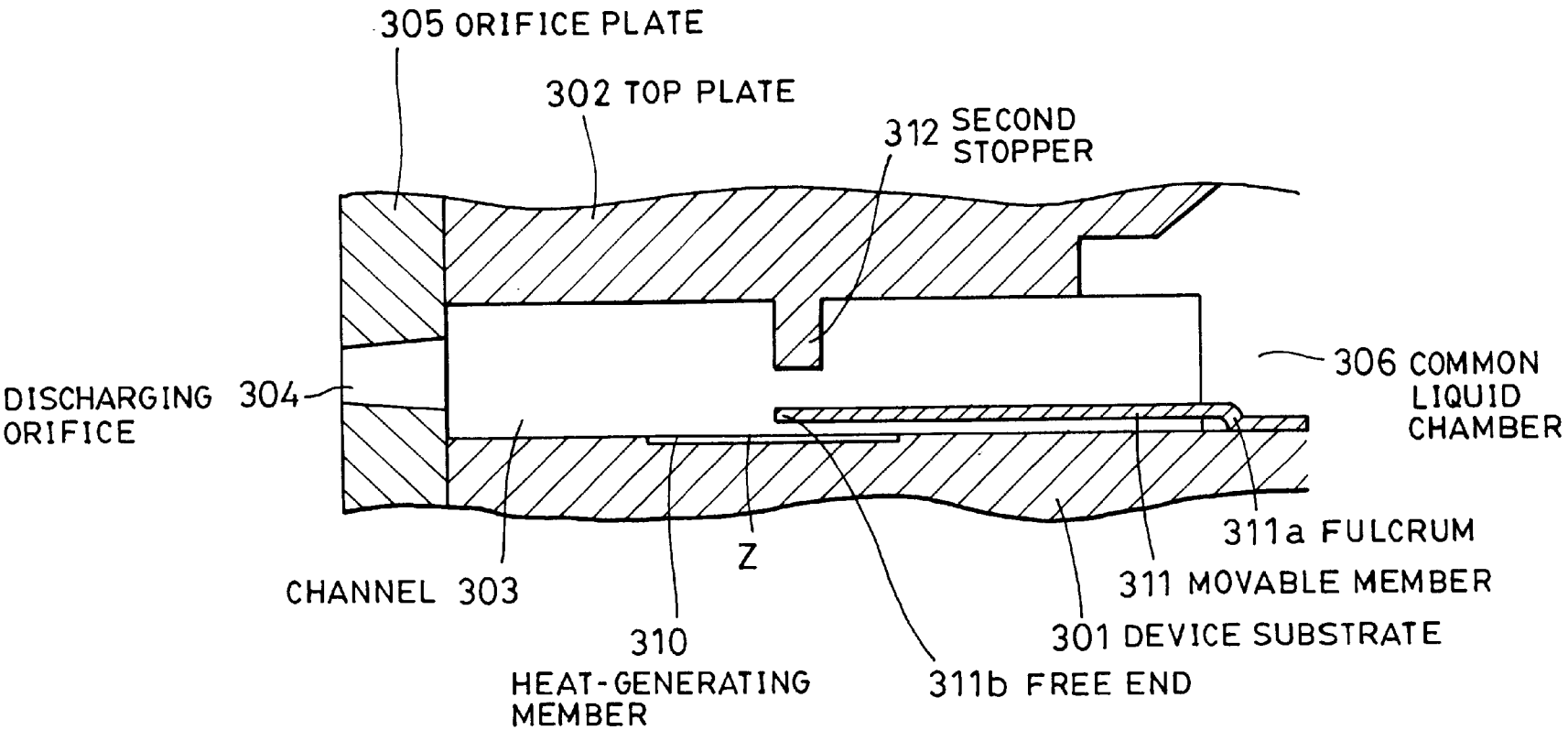
FIG. 14 is a side cross-sectional diagram of an example of a conventional edge shooter type liquid discharging head having a stopper.
Figure 15:
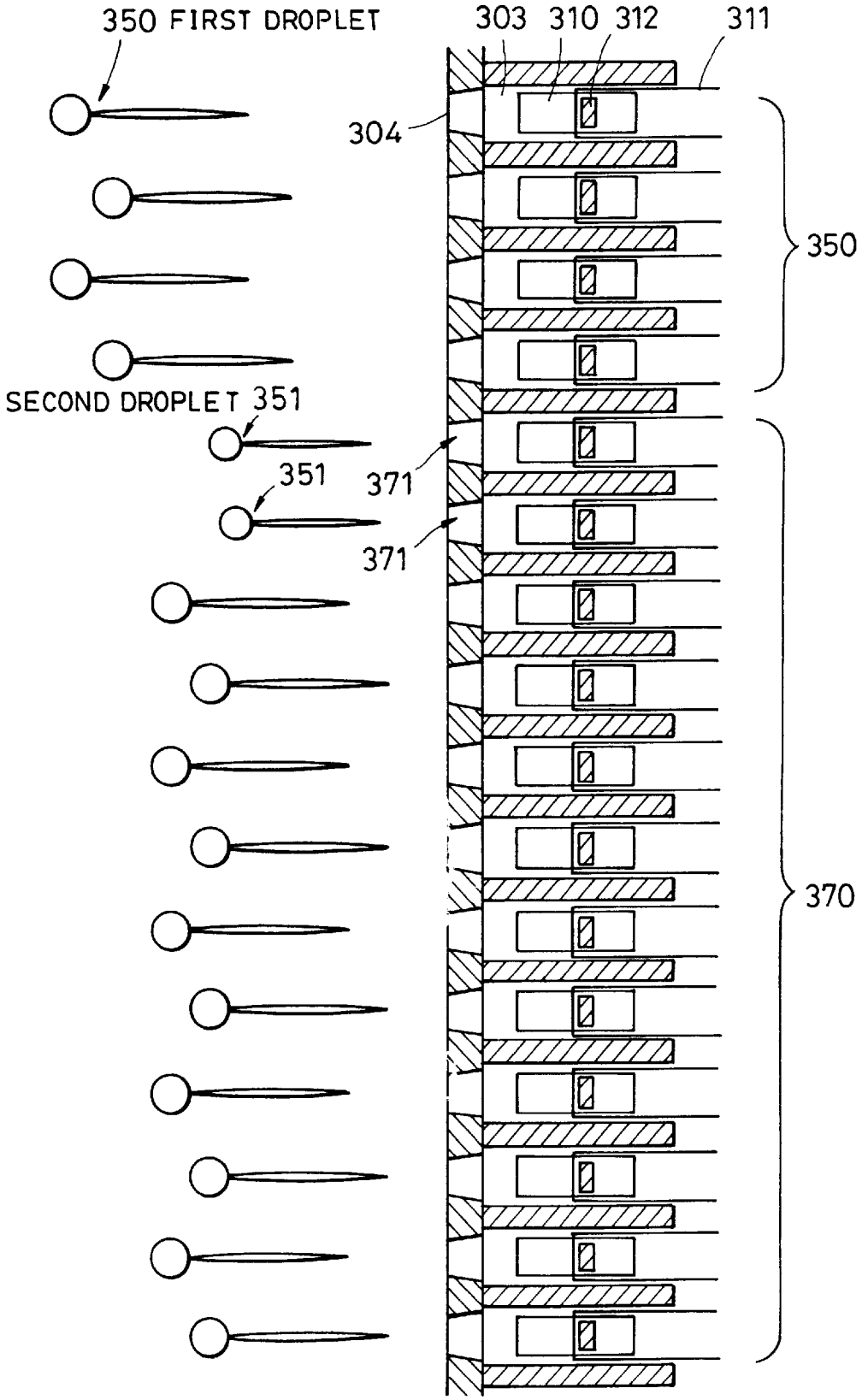
FIG. 15 is a diagram schematically illustrating the discharging amount and discharging speed of ink discharged from the conventional liquid discharging head shown in FIG. 14.
Figure 16:
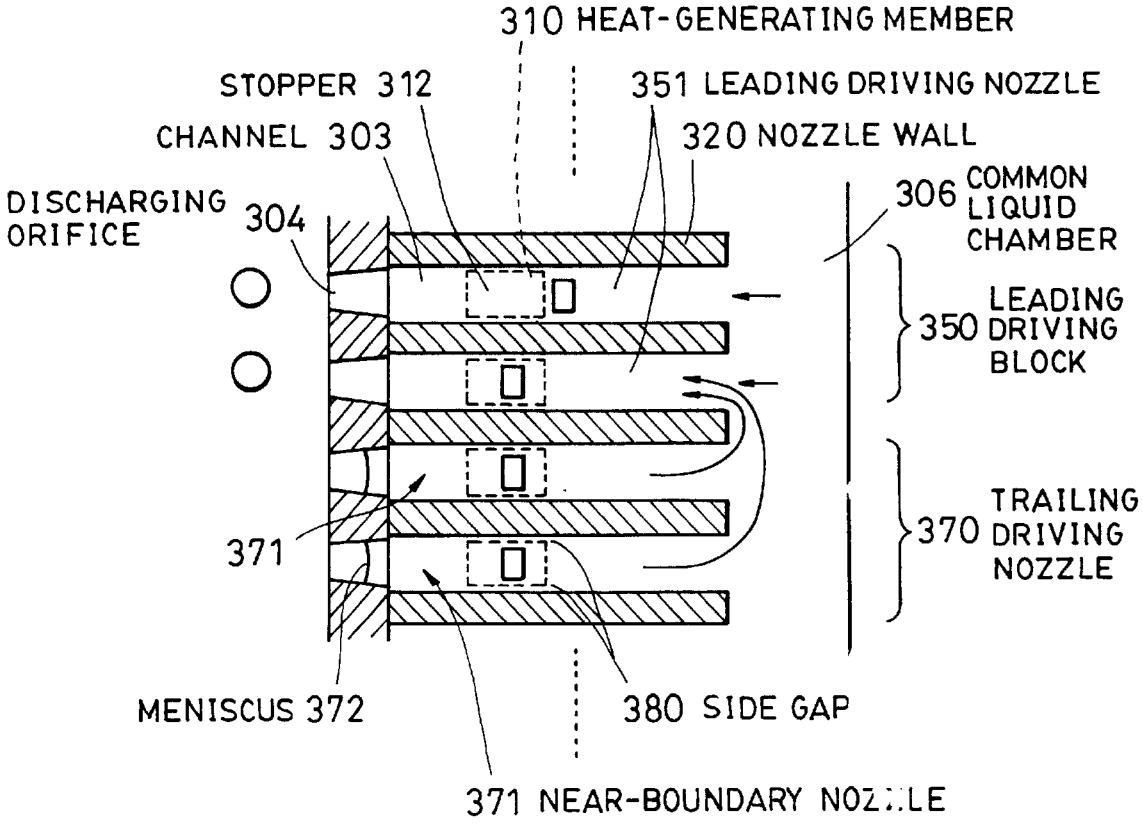
FIG. 16 is a schematic diagram illustrating the state of a conventional liquid discharging head wherein ink is drawn out of near-boundary nozzles near the boundary with a block that has been driven.

FIG. 13 a block diagram of the entire liquid discharging apparatus for performing ink-jet recording with the above-described liquid discharging head.

The liquid discharging apparatus receives recording information from a host computer 400 as control singals. The recording information is temporarily stored in an input interface 401 within the liquid discharging apparatus, and also converts into data which can be processed within the liquid discharging apparatus, and is input to a CPU (Central Processing Unit) 402 also serving as head driving signal supplying means. The CPU 402 processes data input to the CPU 402 using peripheral units such as RAM (Random Access Memory) 404 or the like, based on control programs saved in ROM (Read-Only Memory) 403, and converts the data into data to be recorded (image data).

Also, the CPU 402 creates driving data for driving the driving motor 406 for moving the recording sheet and the carriage HC upon which is mounted the recording head unit in a manner synchronous with the image data, for recording the image data on an appropriate position on the recording sheet. The image data and motor driving data are transmitted to the recording head unit 200 and the driving motor 406 via a head driver 407 and motor driver 405, respectively, and both are driven a controlled timings so as to form an image.

Recording media 150 used with such a liquid discharging apparatus to be recorded with a liquid such as ink or the like include, for example, various types of paper, OHP heets, plastic material used for compact disks or accessory plates, cloth, metal material such as aluminum or copper, leather materials such as animal skins or synthetic leather, wood materials such as solid wood or plywood, bamboo material, ceramics such as tiles or the like, three-dimensional materials such as sponge, and so forth.

Also, examples of the liquid discharging apparatus include printer apparatuses for recording on various types of paper or OHP sheets or the like, plastic recording apparatuses for recording on plastic materials such as compact disks or the like, metal recording apparatuses for recording on metal plates, leather recording apparatuses for recording on leather, wood recording apparatuses for recording on wood, ceramics recording apparatuses for recording on ceramics, recording apparatuses for recording on three-dimensional netting materials such as sponge, textile printers for recording on cloth, and so forth.

Liquids suitable for the recording medium and recording conditions should be used for the discharging liquid discharged from the liquid discharging heads.

Note that the numerical values described in the present embodiments are but an example and the present invention is not restricted to such.

As described above according to the present invention, liquid within a channel that has not been driven being drawn out under the effects of refilling channels having heat-generating members that have been driven can be suppressed by the second restricting unit, so recession of the meniscus formed at the discharging orifices connecting to channels having the second restricting members can be suppressed. Accordingly, irregularities in recording due to meniscus regression can be suppressed.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modification and equivalent structures and functions.

What is claimed is:

1. A liquid discharging head, comprising:

a plurality of heat-generating elements for generating thermal energy for generating bubbles in a liquid;

a plurality of discharging orifices corresponding respectively to said plurality of heat-generating elements, whereby the liquid is discharged;

a plurality of channels connecting respectively to said plurality of discharging orifices and each having a bubble generating area for generating a bubble in the liquid;

a plurality of movable members provided respectively in said bubble generating areas of said channels and corresponding respectively to said plurality of heat-generating elements, each said movable member having a free end which is displaced in accordance with growth of the bubble;

a plurality of restricting portions provided respectively in said plurality of channels and corresponding respectively to said plurality of movable members, for restricting an amount of movement of said movable members, respectively; and a common liquid chamber connected to each of said channels, for supplying the liquid to each of said channels, wherein said heat-generating elements are grouped into a plurality of blocks, said blocks of heat-generating elements are sequentially driven in time-division, said heat-generating elements within any given block discharge the liquid substantially simultaneously, and the liquid is discharged from said discharge orifices by means of the bubbles being generated, and wherein said plurality of restricting portions includes a first restricting portion and a second restricting portion, said second restricting portion having a form such as to generate a fluid resistance to flow of the liquid from a side of said discharging orifice toward said common liquid chamber which is greater than a fluid resistance to flow of the liquid from the side of said discharging orifice toward said common liquid chamber generated by said first restricting portion, and said first and second restricting portions being provided in adjacent channels, said second restricting portion being provided in a different channel from that in which said first restricting portion is provided.

2. A liquid discharging head according to claim 1, wherein said second restricting portion is provided in one of said channels positioned adjacent a boundary between a leading driving block and a trailing driving block, and is associated with said trailing driving block, which is driven later than said leading driving block.

3. A liquid discharging head according to claim 2, wherein said second restricting portion has greater dimensions than said first restricting portion.

4. A liquid discharging head according to claim 2, wherein a liquid flow direction length of said second restricting portion is greater than that of said first restricting portion, the liquid flow direction length being a length in a direction in which the liquid flows through said respective channel.

5. A liquid discharging head according to claim 2, wherein a frontal projection area of said second restricting portion in a direction in which the liquid flows through said respective channel is greater than the frontal projection area of said first restricting portion in the direction in which the liquid flows through said respective channel.

6. A liquid discharging head according to claim 2, wherein a spacing between said second restricting portion and a wall face forming said respective channel is narrower than a spacing between said first restricting portion and a wall face forming said respective channel.

7. A liquid discharging head according to claim 1, further comprising a third restricting portion which generates a fluid resistance to flow of the liquid from the side of said discharging orifice toward said common liquid chamber which is greater than that generated by said first restricting portion and which is smaller than that generated by said second restricting portion, said third restricting portion being disposed in one of said channels positioned adjacent to said channel in which said second restricting portion is disposed.

8. A liquid discharging apparatus, comprising:

a liquid discharging head according to any one of claims 1 through 7; and a control unit for controlling the sequential driving of said blocks.

9. A liquid discharging apparatus according to claim 8, further comprising recording medium transporting means for transporting a recording medium for receiving the liquid discharged from said liquid discharging head.

10. A liquid discharging apparatus according to claim 9, wherein said apparatus records by discharging the liquid from said liquid discharging head so that the liquid adheres to the recording medium.

11. A method for manufacturing a liquid discharging head, said liquid discharge head comprising:

a plurality of channels formed by joining an essentially flat substrate having a plurality of movable members corresponding respectively to a plurality of heat-generating elements for generating thermal energy for generating bubbles in a liquid, the movable members each having a free end which is displaced in accordance with growth of a bubble, with a top plate formed with a grooved portion having a plurality of restricting portions corresponding respectively to the movable members, for restricting an amount of displacement of the movable members, respectively, the plurality of channels connecting respectively to a plurality of discharging orifices for discharging the liquid, each of the channels having a bubble generating area for generating a bubble in the liquid; and a common liquid chamber connected to each of the channels, for supplying the liquid to each of the channels, wherein the heat-generating elements are grouped into a plurality of blocks, the blocks of heat-generating elements are sequentially driven in time-division, the heat-generating elements within any given block discharge the liquid substantially simultaneously, and the liquid is discharged from the discharge orifices by means of the bubbles being generated, said method comprising a step for forming the top plate such that the plurality of restricting portions includes a first restricting portion and a second restricting portion, the second restricting portion having a form such as to generate a fluid resistance to flow of the liquid from a side of the discharging orifice toward the common liquid chamber which is greater than a fluid resistance to flow of the liquid from the side of the discharging orifice toward the common liquid chamber generated by the first restricting portion, and the first and second restricting portions being provided in adjacent channels, said second restricting portion being provided in a different channel from that in which said first restricting portion is provided.

12. A method for manufacturing a liquid discharging head according to claim 11, further comprising a step wherein the second restricting portion is formed in one of the channels positioned adjacent a boundary between a leading driving block and a trailing driving block, and is associated with the trailing driving block, which is driven later than the leading driving block.

13. A method for manufacturing a liquid discharging head according to claim 12, further comprising a step wherein the second restricting portion is formed to have greater dimensions than the first restricting portion.

14. A method for manufacturing a liquid discharging head according to claim 12, further comprising a step for forming the second restricting portion such that a liquid flow direction length of the second restricting portion is greater than that of the first restricting portion, the liquid flow direction length being a length in a direction in which the liquid flows through the respective channel.

15. A method for manufacturing a liquid discharging head according to claim 12, further comprising a step for forming the second restricting portion such that a frontal projection area of the second restricting portion in a direction in which the liquid flows through the respective channel is greater than the frontal projection area of the first restricting portion in the direction in which the liquid flows through the respective channel.

16. A method for manufacturing a liquid discharging head according to claim 12, further comprising a step for forming the second restricting portion such that a spacing between the second restricting portion and a wall face forming the respective channel is narrower than a spacing between the first restricting portion and a wall face forming the respective channel.

17. A method for manufacturing a liquid discharging head according to claim 11, further comprising a step for forming a third restricting portion which generates a fluid resistance to flow of the liquid from the side of the discharging orifice toward the common liquid chamber which is greater than that generated by the first restricting portion and which is smaller than that generated by the second restricting portion, the third restricting portion being disposed in one of the channels positioned adjacent to the channel in which the second restricting portion is disposed.

* * * * *

UNITED STATES PATENT AND TRADEMARK OFFICE

CERTIFICATE OF CORRECTION

PATENT NO. : 6,513,914 B2
DATED : February 4, 2003
INVENTOR(S) : Yoshinori Misumi et al.

It is certified that error appears in the above-identified patent and that said Letters Patent is hereby corrected as shown below:

Drawings,
SHEET 1, FIG. 1, “HEAT-GENEHATING” should read -- HEAT-GENERATING --.
SHEET 3, FIG. 3, “HESISTANCE” should read -- RESISTANCE --.

Column 1,
Line 11, “likes” should read -- like, --;
Line 20, “media” should read -- media. --;
Line 23, “net” should read -- not --; and
Line 43, “also, and” should be deleted.

Column 2,
Line 7, “bubbles with” should read -- bubbles. With --; and
Line 40, “to” should be deleted.

Column 3,
Line 28, “he” should read -- the --.

Column 5,
Line 39, “Resistance” should read -- resistance --.

Column 6,
Line 59, “prising” should read -- prise --.

Column 11,
Line 26, “one” should be deleted.

Column 13,
Line 30, “tailings” should read -- tailing --.

Column 14,
Line 11, “rabidly” should read -- rapidly --.

Column 15,
Line 7, “signals” should read -- signals. --.

Column 16,
Line 4, “Also.,” should read -- Also, --.

Column 17,
Line 57, “singals.” should read -- signals --.

UNITED STATES PATENT AND TRADEMARK OFFICE

CERTIFICATE OF CORRECTION

PATENT NO. : 6,513,914 B2
DATED : February 4, 2003
INVENTOR(S) : Yoshinori Misumi et al.

It is certified that error appears in the above-identified patent and that said Letters Patent is hereby corrected as shown below:

Column 18,
Line 11, “heets,” should read -- sheets, --; and
Line 35, “above” should read -- above, --.

Signed and Sealed this

Twenty-first Day of October, 2003

JAMES E. ROGAN
*Director of the United States Patent and Trademark Office*